US006111359A

United States Patent [19]

Work et al.

[11] Patent Number: 6,111,359

[45] Date of Patent: Aug. 29, 2000

[54] INTEGRATED HID REFLECTOR LAMP WITH HID ARC TUBE IN A PRESSED GLASS REFLECTOR RETAINED IN A SHELL HOUSING A BALLAST

[75] Inventors: Dale Work, Flemington, N.J.; Mark Fellows, New Fairfield, Conn.; Gregory Nelson, Painted Post; Kent Collins, Hammondsport, both of N.Y.; Robertus A. J. Keyser, Veldhoven, Netherlands; Andrew Jackson, Hammondsport, N.Y.; Oscar J. Deurloo, Veldhoven, Netherlands; Aswin J. G. Linden, Weert, Netherlands; Peter A. Seinen, Veldhoven, Netherlands; Willem J. Van Den Hoek, GB St. Oedenrode, Netherlands; Hendrik A. Van Esveld, Geldrop, Netherlands; Josephus C. M. Hendricx, Geldrop, Netherlands

[73] Assignee: Philips Electronics North America Corporation, New York, N.Y.

[21] Appl. No.: 08/647,385

[22] Filed: May 9, 1996

[51] Int. Cl.[7] ..... H01J 7/44

[52] U.S. Cl. ..... 315/56; 315/58; 315/246; 313/25

[58] Field of Search ..... 315/56, 58, 59, 315/60, 61, 71, 72, 73, 246; 313/609, 634, 25, 17

[56] References Cited

U.S. PATENT DOCUMENTS

| | | | |
|---|---|---|---|
| 4,463,286 | 7/1984 | Justice | 315/219 |
| 4,484,108 | 11/1984 | Stupp et al. | 315/219 |
| 4,490,649 | 12/1984 | Wang | 315/50 |
| 4,672,270 | 6/1987 | Ito et al. . | |
| 4,929,863 | 5/1990 | Verbeek et al. . | |
| 4,935,668 | 6/1990 | Hansler et al. . | |
| 4,961,019 | 10/1990 | White et al. | 313/25 |
| 5,424,609 | 6/1995 | Geven et al. | 313/623 |

FOREIGN PATENT DOCUMENTS

| | | |
|---|---|---|
| 0191742A2 | 8/1986 | European Pat. Off. . |
| 2146185A | 4/1985 | United Kingdom . |

*Primary Examiner*—David Vu
*Attorney, Agent, or Firm*—Brian J. Weighaus

[57] ABSTRACT

An integrated reflector lamp includes a sealed envelope enclosing a high pressure gas discharge device. A shell has a rim portion which receives the sealed envelope and an opposing basal portion carrying a screw base. A ballast for igniting and operating the discharge device is enclosed within the shell between the screw base and the sealed envelope. The sealed envelope includes a reflective surface which directs light emitted by the discharge device. The reflective surface also provides effective heat management for preventing overheating of the ballast by the heat generated by the discharge device. The integrated lamp has photometrics and luminous efficacy which exceeds that of corresponding halogen and halogen IR reflector lamps while having an overall planform which fits within that of the corresponding lamp. In a favorable embodiment, the ballast drives the discharge device at a high frequency above about 19 kHz and below the lowest acoustic resonant frequency of the discharge device, facilitating a small physical size for the ballast while also avoiding acoustic resonance. In one embodiment, the reflector lamp fits within the ANSI outline for a PAR 38 lamp and has total lumens at least substantially equal to and a luminous efficacy which substantially exceeds that of a corresponding PAR 38 lamp having an incandescent filament.

42 Claims, 13 Drawing Sheets

INTEGRATED HID REFLECTOR LAMP WITH HID ARC TUBE IN A PRESSED GLASS REFLECTOR RETAINED IN A SHELL HOUSING A BALLAST

CROSS REFERENCE TO RELATED APPLICATIONS

This application relates to U.S. application Ser. No. 08/647,384, now U.S. Pat. No. 5,828,185 filed concurrently herewith entitled "High Frequency HID Lamp System" of Mark Fellows et al which discloses and claims a lamp system including an HID discharge lamp and a high frequency ballast which operates the discharge lamp below the lowest lamp resonant frequency and above the audible.

BACKGROUND OF THE INVENTION

The invention relates to a reflector lamp comprising a light source energizeable for emitting light, a reflector body having a reflective surface for directing light emitted by the light source, and a lamp base having lamp contacts electrically connected to the light source.

Such lamps are well known in the industry and include, for example, parabolic aluminized reflector (PAR) lamps. PAR lamps have a sturdy lamp envelope with a pressed glass reflector body having an internal parabolic reflective surface and a pressed glass cover hermetically sealed to the reflector body. Historically, the light source has been an incandescent filament. More recently, the light source has been a halogen burner, which provides greater efficacy than with a conventional bare incandescent filament. Still further improvements in the art have led to the use of halogen burners which include infrared reflective coatings on the burner capsule or on a sleeve within or outside the burner capsule. The coating reflects otherwise-wasted infrared radiation back onto the filament. This raises the temperature of the filament and increases useful light output for a given power consumption.

PAR lamps come in many different sizes and have many different applications. These include general indoor and outdoor spot and flood lighting, such as for buildings, statues, fountains and sports grounds, as well as accent lighting, such as for retail store window displays, hotels, restaurants and theaters.

As part of a worldwide movement towards more energy efficient lighting, recent government legislation in the United States (commonly referred to as the National Energy Policy Act "EPACT") has mandated lamp efficacy values for many types of commonly used lamps including parabolic aluminized reflector (PAR) lamps. These minimum efficacy values became effective in 1995 and only products meeting these efficacy levels are allowed to be sold in the United States. The efficacy values for PAR-38 incandescent lamps have been established for various wattage ranges. For example, lamps of 51–66 W must achieve 11 lumens per Watt (LPW), lamps of 67–85 W must achieve 12.5 LPW, lamps of 86–115 W must achieve 14 LPW and lamps in the range 116–155 W must achieve 14.5 LPW.

There are few PAR 38 lamps currently on the market with a reflective coating of aluminum and an incandescent filament which pass the EPACT standards and which have a commercially acceptable life of 1000 hours. Those that do barely exceed the minimum standards, and further substantial improvements seem unlikely. Accordingly, the market is rapidly shifting to PAR lamps which have halogen burners or halogen IR burners.

However, one disadvantage of commercial halogen and halogen IR lamps is their relatively short lifetime for acceptable efficacy. For example, a commercially available 90 W lamp has an average lifetime of about 2500 hours while that of a 60 W halogen IR lamp is only slightly greater at 3000 hours. It would be desirable to have a significantly longer lifetime since re-lamping, especially for fixtures in high places, can easily exceed the cost of the lamp being replaced. Another disadvantage is the luminous efficacy is limited to below about 20 LPW. For example, the 90 W halogen PAR lamp has a luminous efficacy of about 16 LPW while the 60 W PAR with a halogen IR burner has a luminous efficacy of about 19 LPW. Further improvements in efficacy for these lamps at a fixed life would be expected to be less than about 5%. Still another disadvantage is that the color temperature is limited for tungsten filament lamps to a maximum of 3650 K, the melting point of tungsten. Typically, however, the color temperature is confined to a range of about 2600–3000 K to achieve a commercially acceptable lamp life. It would be desirable to offer lamps with a different color temperature because this enables the lamp to be tailored for specific applications. For example, it is generally desirable that for cool environments a warm color temperature (for example 3000 K) is desired whereas for a warm environment a cool color temperature (for example 4500 K) is desired.

Still other reflector lamps are known which include a blown glass envelope and contain a bare incandescent filament. These are generally known as "R" lamps, and have even lower luminous efficous than the PAR lamps, for example on the order of 9–11 LPW, and the same colorimetric limitations.

SUMMARY OF THE INVENTION

Accordingly, it is an object of the invention to provide a reflector lamp with improved efficacy.

It is another object to provide a reflector lamp with improved lamp life.

It is yet another object to provide a reflector lamp with greater flexibility with respect to photometric parameters such as color temperature and color rendering.

It is a further object of the invention to provide such a lamp which can be operated in the same fixtures as incandescent and halogen PAR lamps and incandescent "R" lamps.

According to the invention, the above objects are accomplished in that a lamp according to the type described in the opening paragraph:

is an integrated HID reflector lamp for retrofitting a corresponding reflector lamp comprising an incandescent filament, a glass reflector body and a lamp cap having a screw base, the incandescent reflector lamp having a prescribed outline, total lumens and luminous efficacy, the HID reflector lamp being characterized by:

a shell having a wall enclosing an internal volume, the wall having a circumferential rim portion defining a light emitting opening of the shell and an opposing basal portion, the shell generally tapering with increasingly smaller diameter from the rim portion to the basal portion, a screw base secured on the basal portion, a high pressure arc discharge device arranged relative to the shell, a reflective surface positioned within the shell for reflecting light emitted by the discharge device out through the light emitting opening, and a ballast within the shell body for energizing the discharge device to emit light, the ballast including input terminals connected to the screw base and output terminals connected to the discharge device, the ballast being responsive, when an operating voltage from an ordinary electric utility line that normally powers the incandescent PAR lamp is applied to the shell on the screw base, to ignite and maintain a gas discharge within the discharge device, the integrated HID lamp having an outline substantially entirely within the outline of the corresponding reflector lamp, and having total lumens at least substantially equal to and a luminous efficacy substantially greater than the corresponding reflector lamp.

The above-described embodiment provides a reflector lamp which is a significant energy-saving substitute for the known PAR lamps having an incandescent filament, including halogen and halogen IR lamps, as well as the known "R" lamps. The lamp according to this embodiment fits in the same fixtures as the corresponding lamp, screws into the same sockets, and operates off of the same power line voltage. Thus, retrofitting is simple. Furthermore, in addition to the substantially improved luminous efficacy, the gas discharge device can be designed, through selection of the fill constituents such as with different metal halides, to have colorimetric parameters, such as color temperature, over a wider range than is possible with incandescent, halogen and halogen IR PAR lamps and the R lamps. Thus, there is greater flexibility for the lamp designer to tailor the lamp to a particular environment. According to one commercially significant implementation, the lamp has an outline substantially within that of the ANSI outline for a PAR 38 lamp, which is widely used in lighting public spaces.

According to yet another embodiment, during normal lamp operation the discharge device is free of acoustic resonances at alternating lamp currents below a lowest lamp resonant frequency, and the ballast circuit energizes the discharge lamp so as to have an alternating lamp current having a fundamental frequency and harmonics which are integral multiples of the fundamental frequency. The fundamental frequency and the lowest lamp resonant frequency (on a current basis) are greater than about 19 kHz, and the harmonics above the lowest lamp resonant frequency have magnitudes which are insufficient to induce acoustic resonance.

High frequency AC operation of an HID lamp is desirable because it enables the inductive elements of the ballast to be greatly reduced in size, as well as offering some increase in system efficiency relative to 60 Hz operation due to lower ballast losses. However, such operation has been hampered in prior art systems because of the presence of acoustic resonance at or near the fundamental frequency of the ballast. The frequencies at which acoustic resonance occurs depend on many factors, including the dimensions of the discharge vessel (i.e., length, diameter, end chamber shape, the presence or absence of a tubulation), the density of the gas fill, operating temperature and lamp orientation. As used herein "acoustic resonance" is meant that level of resonance which causes disturbances of the discharge arc visible to the human eye.

With prior art systems known inter alia from the article "An Autotracking System For Stable Hf Operation of HID Lamps", F. Bernitz, Symp. Light Sources, Karlsruhe 1986, the discharge devices had acoustic resonance occurring at low and midrange frequencies (for example, 100–500 Hz and 5000–7000 Hz) as well as at high frequencies above about 19 kHz. The discharge devices were of quartz and frequently had only limited, narrow operating windows bounded at the low and high end by frequencies at which acoustic resonance occurs. Furthermore, the discharge vessels were of quartz glass, for which tight dimensional control is difficult in high speed manufacturing. Consequently, even for discharge devices of the same type and wattage, the system designer was faced with narrow operating windows which would be different not only for lamps from different manufacturers, but also from lamp to lamp for the same manufacturer. Prior art systems have typically relied on complex sensing and operating schemes to evade operation at acoustic resonance. However, circuits for these systems are costly, complex and not intended for integrated lamps.

According to the above embodiment, however, the inventors have discovered that the arc discharge device can be selected to have its lowest acoustic resonance frequency (on a current basis) at a frequency substantially higher than the audible frequency of about 19 kHz, in one embodiment at about 30 kHz, thereby allowing safe operation in the window above about 19 kHz and the lowest resonance frequency. This permits a relatively simple, compact, low cost ballast circuit without complicated sensing or operating schemes.

It should be noted that acoustic resonance is technically induced by the lamp power, i.e., the product of the lamp current and lamp voltage. As such, acoustic resonances can be defined in terms of power frequencies, which are generally twice the lamp current frequencies since the lamp current and voltage are typically closely in phase for most high frequency ballasts. However, the corresponding lamp current frequency at which acoustic resonance occurs for a given discharge device operated on a given ballast is readily identifiable. Accordingly, the acoustic resonance frequencies will be stated herein in terms of lamp current frequencies and lamp power frequencies, and where only one is given, the other can be readily determined from the 1:2 relationship given above.

The invention is also based on the recognition that acoustic resonance can be induced not only by the fundamental driving frequency but also by harmonics of the output current (or power) of the typical electronic ballast. Even if the fundamental frequency is well below the lowest resonant frequency of the lamp, acoustic resonance could still be induced by harmonics with sufficient amplitude above the lowest lamp resonant frequency. Consequently, for resonance free operation, the ballast must have a driving signal in which any harmonics above the lowest lamp resonant frequency are sufficiently small in amplitude so as not to induce acoustic resonance.

In still another embodiment, the ballast maintains the fundamental frequency substantially constant during steady state lamp operation. This further reduces cost and size of the ballast for the lamp by eliminating many of the control components of the prior art system associated with charging and sweeping the frequency and maintaining constant power.

Favorably, the discharge vessel comprises a ceramic wall. The term "ceramic wall" is here understood to mean a wall of a refractory material such as monocrystalline metal oxide (for example, sapphire), polycrystalline metal oxide (for example, polycrystalline densely sintered aluminum oxide; yttrium-aluminum garnet, or yttrium oxide), and polycrystalline non-oxidic material (for example, aluminum nitride). Such materials allow for high wall temperatures up to 1400–1600 K and are satisfactorily resistant to chemical attacks by halides, halogens and by Na. This has the advantage that the dimensional tolerances for discharge vessels of ceramic material are much smaller than those for conventional pressed quartz glass technology. The lower tolerances enable, on a lamp-to-lamp basis, much greater uniformity with respect to acoustic resonance characteristics as well as colorimetric properties.

According to another embodiment, the discharge device includes a central cylindrical zone with end walls. The end walls being spaced by an axial distance "L" and the central zone having an inner diameter "ID", and the ratio L:ID is about 1:1. Lamps having a ceramic discharge vessel with such a central zone are known, for example, from U.S. Pat. No. 5,424,609 (Gevens et al). However, in the disclosed lamp, the central zone is longer and narrower than 1:1, having an L:ID ratio of about 4:3 or greater. The inventors have found that ratios of about 1:1 yield a maximum in the lowest lamp resonant frequency. At this ratio, the first acoustic resonance for the longitudinal direction (controlled by the dimension L) substantially coincides with the first acoustic resonance for the radial and azimuthal directions (controlled by the dimension ID) Generally, as the ratio moves away from 1:1, the larger dimension will lower the frequency at which acoustic resonance occurs for the respective radial/azimuthal or longitudinal modes, thereby being determinative of the lowest lamp resonant frequency.

According to a very favorable embodiment, the system includes a plurality of discharge vessels each having a lowest resonant frequency (on a current basis) above about 19 kHz and energized by the ballast to concurrently emit light. The present inventors are unaware of any practical discharge devices in quartz glass which have their lowest resonant frequency on a current basis above about 19 kHz. Furthermore, even with a ceramic discharge vessel having an L:ID ratio of about 1:1 discussed above, the maximum rated wattage for such a discharge device having a lowest resonant frequency above 19 kHz (on a current basis) is expected by the inventors to be about 35 Watts. This embodiment is significant for providing relatively high light output yet which can be operated above about 19 kHz without acoustic resonance.

Favorably, the multiple discharge devices are enclosed in a common lamp outer envelope. The discharge devices may be electrically connected in series. Connecting the discharge devices in series ensures that each device has the same lamp current.

In still another embodiment, the reflector lamp includes a plurality (such as a pair) of discharge vessels connected electrically in parallel. In this arrangement, one of the discharge devices will ignite and burn while the other does not. However, upon the end of life of one of the discharge devices, the other discharge device will then ignite and burn, effectively increasing the life by the integer number of discharge devices present. This also has the advantage of offering instant restrike for a hot lamp, since when a discharge device extinguishes, the other colder discharge device which had not been burning will ignite.

According to a still another embodiment, the light source is a high pressure gas discharge device, and the lamp further comprises (i) a pressed glass lamp envelope sealed in a gas tight manner and enclosing the high pressure gas discharge device, the pressed glass lamp envelope including the reflector body having the reflective surface, (ii) a shell having a first end portion carrying the lamp base and a second end portion receiving the lamp envelope, and (iii) a ballast for energizing the discharge device to emit light, the ballast being mounted within the shell between the pressed glass lamp envelope and the first end portion, the ballast including a pair of input terminals each electrically connected to a respective contact on the lamp base and a pair of output terminals each electrically connected to the discharge device, the lamp envelope being received at the second shell end portion with the reflective surface positioned to reflect light and heat generated by the discharge device away from the ballast.

It has been found that the pressed glass reflector body directs substantial heat generated by the discharge device away from the ballast components, even in the base-up condition. This is due to the reflective surface as well as the thickness of the pressed glass. In comparison a thin-walled blown glass lamp envelope without a reflective surface as known from U.S. Pat. No. 4,490,649 required the use of an internal glass baffle, having an IR reflecting film, positioned within the envelope to achieve suitable ballast temperatures. This provides a rather complicated construction as the lead-wires connected to the discharge device must pass through the baffles.

According to another embodiment, the integrated lamp includes a circuit board having a first side and a second side carrying circuit components of the ballast, the circuit board being mounted within the shell with the first side facing the reflector body and with the second side facing the lamp base, the circuit board defining a first compartment within the shell between the reflector body and the circuit board and a second compartment between the circuit board and the lamp base, and the circuit board being substantially imperforate and being secured to the shell to retard communication of air between the first compartment and the second compartment within the shell. This construction has the advantage that the circuit board acts as an air flow barrier, preventing air circulation against the hot, rear surface of the reflector body from transferring heat via convection within the shell to the circuit components. This also provides a simpler construction from that shown in U.S. Pat. No. 4,490,649, which employs an axially mounted circuit board and an additional body of insulation material in the shell between the circuit board and the lamp envelope.

In yet another embodiment, the ballast operates the discharge device with a lamp current having a constant polarity, i.e., on DC. This has the advantage of not inducing acoustic resonance, thereby alleviating the restrictions imposed on arc tube shape etc. necessary for high frequency AC operation, while still permitting a compact circuit which will allow a compact integrated reflector lamp.

These and other aspects, features and advantages of the invention will become apparent with reference to the drawings and the following detailed description.

BRIEF DESCRIPTION OF THE DRAWINGS

FIG. 5(*b*) illustrates a recurrent start feature of the ballast;

FIG. 6(*b*) illustrates the harmonics in lamp current;

FIG. 6(*c*) illustrates the harmonics in the lamp voltage;

FIG. 6(*d*) illustrates the harmonics in the lamp power;

FIG. 11(*b*) illustrates a mount construction for two discharge devices in parallel.

DESCRIPTION OF THE PREFERRED EMBODIMENTS

Figure 1:
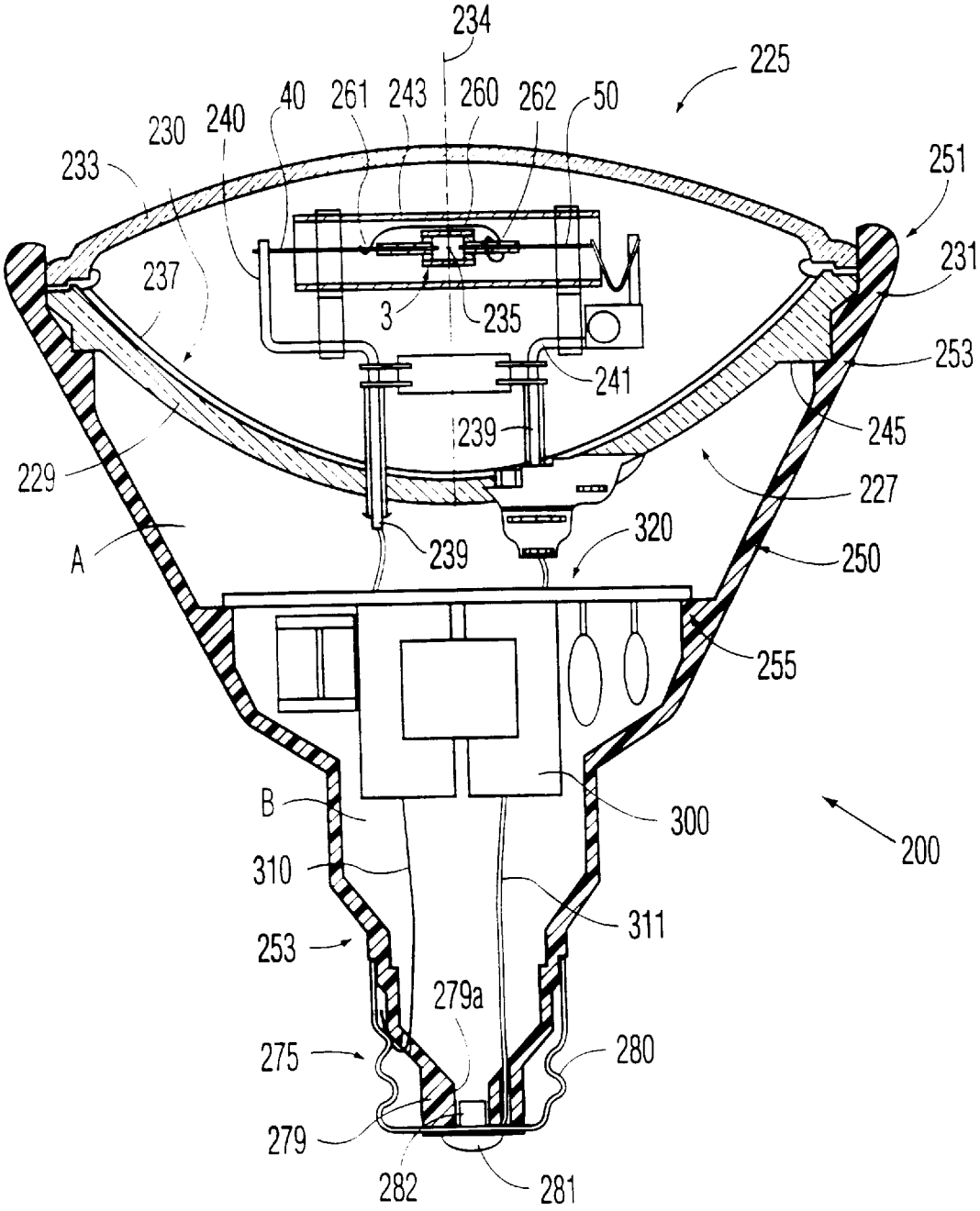
FIG. 1 shows an integrated HID reflector lamp having a unitary structure including a sealed reflector unit, a ballast and a shell enclosing the ballast and holding the lamp reflector unit.

FIG. 1 shows an integrated reflector lamp 200 having a sealed reflector unit 225 received in a shell 250 enclosing a ballast 300. The reflector unit has a glass lamp envelope 227 sealed in a gas-tight manner and enclosing a high pressure discharge device 3.

The lamp envelope 227 includes a pressed glass reflector body with a basal portion 229 and a parabolic surface 230 which extends to a rim 231 of the reflector body. (FIG. 1) A cover in the form of a pressed glass lens 233 is hermetically sealed to the reflector body at the rim 231. The parabolic surface 230 has an optical axis 234 with a focus 235 on the optical axis and has a reflective coating 237 thereon, such as aluminum. Other suitable materials for the reflective coating include silver and multi-layer dichroic coatings. The basal portion of the reflector body includes ferrules 239 through which conductive supports 240, 241 extend in a gas-tight manner. The conductive supports are connected to respective feed-throughs 40, 50 of the discharge device 3. The conductive supports also support a light transmissive sleeve 243 around the discharge device 3. The envelope 227 has a filling of gas which in the absence of a properly sized sleeve would support convection currents during lamp operation. The light transmissive sleeve 243 provides thermal regulation by controlling convective cooling of the discharge device 3.

The shell 250 is molded from a synthetic resin material which withstands the operating temperatures reached by the sealed reflector unit and the ballast. Suitable materials include PBT, polycarbonate, polyethermide, polysulphine and polyphenylsulphine. The shell has a rim portion 251 which holds the outer surface of the rim 231 of the sealed reflector unit and provides a shoulder by which the lamp 200 can be secured in a standard PAR fixture. A circumferential shoulder 253 provides a seat for a corresponding flange 245 of the reflector body. The sealed reflector unit is secured by the rim 251 with a snap fit axially against the shoulder 253. Opposite the rim portion, the shell has a basal portion which receives a screw base 275. The screw base includes an outer threaded metal contact 280 and a center contact 281. The screw base is an Edison type base and is received in an ordinary threaded Edison socket. The screw base has a solderless connection with the input leads 310, 311 from the ballast 300. The lead 310 is clamped between the body 279 and the threaded contact 280. The lead 311 is clamped between a bore wall 279*a* of the body 279 and a shank 282 of the center contact 281. The shell includes a further shoulder 255 which supports a circuit board 320 of the ballast. The shoulder 255 includes tabs (not shown) which extend through respective holes in the circuit board. The tabs have end portions which are pressed against the circuit board, by plastic welding for example, to hold the circuit board against the shoulder.

The sleeve 243 and/or the lens 225 may be constructed to block UV light emitted by the discharge device 3. The UV blocking function may be obtained through the use of UV blocking glass, such as glass with an addition of cerium or titanium, or a UV filter such as a dichroic coating. Such UV blocking glasses and filters are known in the art. The filter may also be applied to the wall of the discharge device 3.

Additionally, the color of the light emitted by the discharge device may be altered by color correcting materials for the ceramic discharge device 3, the sleeve 243 or the lens 225 or with color correcting filters, such as dichroic filters, on these components.

Figure 2:
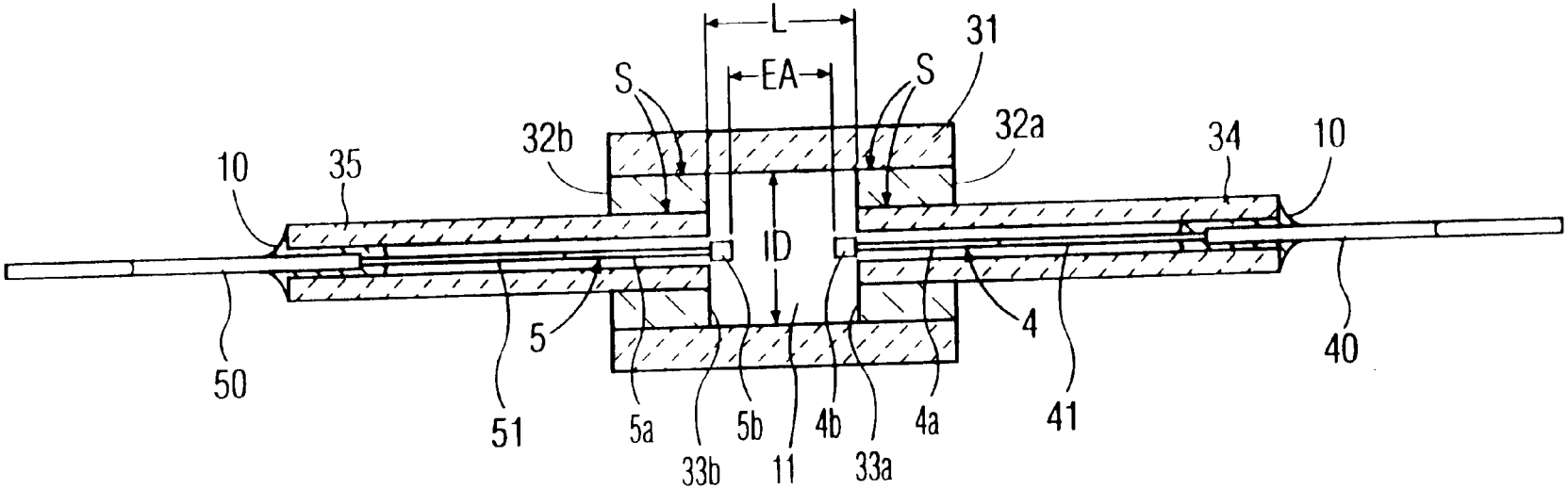
FIG. 2 shows the discharge vessel for the lamp of FIG. 1 in detail.

The discharge device 3 is shown in more detail in FIG. 2 (not true to scale). The discharge vessel is made of ceramic, i.e. it has ceramic walls. The discharge device has a central zone formed from a circular cylindrical wall 31 with an internal diameter "ID" closed off at either end by end wall portions 32*a*, 32*b*, each end wall portion 32*a*, 32*b* forming an end face 33*a*, 33*b* of the discharge space 11. The end wall portions each have an opening in which a ceramic closing plug 34, 35 is fastened in the end wall portion 32*a*, 32*b* in a gas tight manner by means of a sintered joint S. The ceramic closing plugs 34, 35 define opposing end zones of the discharge vessel and each narrowly enclose over a length l a lead-through 40, 41; 50, 51 of an associated electrode 4, 5 provided with a tip 4*b*, 5*b*. The lead-through is connected to the closing plug 34, 35 in a gas tight manner by means of a ceramic glazing joint 10 at its side facing away from the discharge space.

The electrode tips 4*b*, 5*b* are situated at a mutual distance "EA". The lead-throughs each comprise a halide-resistant portion 41, 51 made of, for example, a Mo $Al_2O_3$ cermet, and a portion 40, 50 which is fastened to an associated closing plug 34, 35 in a gas tight manner by means of the ceramic glazing joint 10. The ceramic glazing joint extends over some distance, for example approximately 4 mm. The portions 40, 50 are made of a metal which has a coefficient of expansion which harmonizes very well with that of the closing plugs. For example, Nb is a very suitable material. The lead-through construction described renders it possible to operate the lamp in any burning position as desired.

Each electrode 4, 5 comprises an electrode rod 4*a*, 5*a* which is provided with a winding 4*c*, 5*c* near the tip 4*b*, 5*b*. The electrode tips lie adjacent the end faces 33*a*, 33*b* of the end wall portions. A further description of the discharge device and its closing plug structure is available from U.S. Pat. No. 5,442,609 (Gevens et al), herein incorporated by reference.

A starting aid 260 is secured to the discharge device 3 and consists of a length of wire which has one end 261 connected to the lead-through 40. Its other end 262 is a loop which extends around the opposing closing plug structure. In the area of the loop, the closing plug structure has a gap between the portion 51 and the inner wall of the closing plug 35 in which the starting and buffer gas is present. When an ignition pulse is applied across the lead-throughs 40,50, the leading edge of the starting pulse causes the starting and buffer gas in the area of the loop 262 to ionize. This ionization provides free electrons as well as UV light which generates further electrons that reduce the electric potential required for starting.

Acoustic Resonance Protection

An important feature of the integrated HID reflector lamp according to the invention is the selection of the discharge device to have its lowest acoustic resonant frequency (on a lamp current basis) at a frequency substantially higher than the audible frequency of about 19 kHz. This provides a large frequency window in which the ballast can operate above the audible range without the danger of inducing annoying flicker of the arc or arc displacements which lead to extinguishment or even failure of the discharge device 3.

In a practical embodiment, the lamp according to FIG. 1 was constructed as a retrofit lamp to replace PAR 38 lamps used in, for example, high hat fixtures for lighting commercial establishments, such as the public areas of shopping malls. The discharge device has a rated power of 20 W. The discharge vessel is made of polycrystalline aluminum oxide, has an internal diameter ID of 3.0 mm and an interspacing between the electrode tips "EA" of 2.0 mm. The closing plugs 34, 35 were sintered in the end wall portions 32*a*, 32*b* substantially flush with the end faces 33*a*, 33*b* formed by the end wall portions. The electrodes have a tungsten rod 4*a*, 5*a* provided with a tungsten winding 4*b*, 5*b* at the tip. The distance between each electrode tip and the adjacent end face was about 0.5 mm. The ID was constant over the distance "L" of 3.0 mm between the end faces 33(*a*), 33(*b*).

The discharge vessel has a filling of 2.3 mg Hg and 3.5 mg NaI, $DyI_3$ and TlI in a mole ratio of 90:1.4:8.6. The discharge vessel also contains Ar as a starting and buffer gas. The interior of the sealed reflector envelope 227 has a gas fill of 75% krypton, with the balance $N_2$ at a pressure of 400 Torr. The sleeve 243 has a wall thickness of 1 mm and a clearance of 2 mm from the wall 31 of discharge device 3. In the disclosed embodiment, mercury is used as a buffer to fix the arc voltage at a suitable level. Other buffers may also be used such as zinc and xenon.

The discharge device was found to have a lowest resonant frequency of above 30 kHz (on a lamp current basis) during nominal lamp operation. There are two main groups of acoustic resonances, the first being in the longitudinal (axial) direction of the discharge vessel and the second being the azimuthal/radial resonances. It is desirable to have the lowest resonant frequency for each group to be about the same, since the lowest one determines the upper end of the operating window for the ballast. The longitudinal fundamental frequency is given by $f_{\iota 0}=C/(2*L)$ and the azimuthal/radial fundamental frequency is given by $f_{ar0}=1.84*C/(\pi*ID)$, where "L" and "ID" are the length and internal diameter of the discharge space as shown in FIG. 2 and "C" is the speed of sound. The speed of sound, however, is dependent on the temperature gradient of the gas in the discharge space, and has been found to be different for the longitudinal and radial/azimuthal modes. Based on experimentation, the inventors have found that the speed of sound is approximately 420 m/s for the longitudinal resonances and about 400 m/s for the azimuthal/radial resonances for a discharge vessel with the above-described fill. For the specific 3 mm×3 mm L:ID discharge vessel described above, $f_{\iota 0}\approx 70$ kHz and $f_{ar0}\approx 80$ kHz (on a power frequency basis). These correspond to 35 and 40 kHz, respectively, on a current basis and are regarded as being acceptably close together and substantially the same. However, to bring them closer together, the dimension ID can be made larger relative to the length L, which will lower the fundamental azimuthal/radial frequency towards that of the longitudinal fundamental resonant frequency. For the disclosed discharge device the dimensions L and ID should satisfy the relation $L \leqq D \leqq 1.2\ L$.

Furthermore, it should be noted that the insertion depth of the electrodes has little influence on the lowest acoustic resonance frequency, the insertion depth being only a 2nd to 3rd order influence.

Because of this relatively large frequency window between the lowest resonant frequency of the discharge device 3 and the audible frequency of 19 kHz, the ballast may have a constant frequency during lamp operation, greatly simplifying its design and cost. As further described below, for the above described discharge device, the operating frequency for the fundamental of the lamp current is selected at a nominal 24 kHz. This provides a headroom of about 5 kHz with the lowest resonant frequency of 30 kHz of the discharge device. Still a further aspect relates to controlling the amplitude of higher harmonics of the fundamental frequency, to prevent acoustic resonance by such higher harmonics. This aspect will be further discussed in the following description of the ballast.

The Ballast

Figure 3:
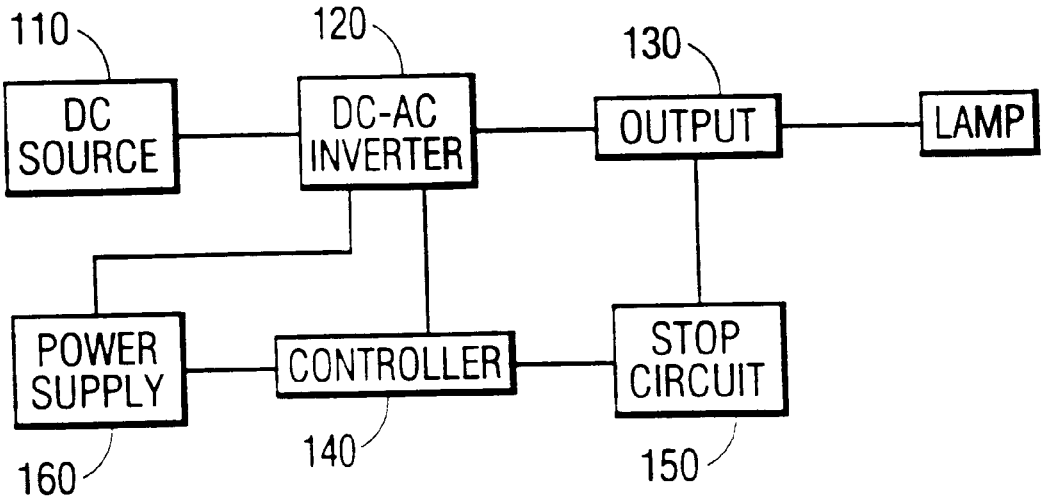
FIG. 3 is a block diagram of a high frequency ballast for operating the lamp of FIG. 1.

FIG. 3 shows a block diagram of a high frequency lamp ballast for operating the lamp of FIG. 1. The ballast has a DC source 110 providing a DC input to DC-AC inverter 120. A resonant output circuit 130 includes the discharge device 3 of FIG. 1 and is coupled to the DC-AC inverter. A control circuit 140 controls the inverter 120 to ignite the lamp and to operate the lamp after ignition with a substantially constant lamp current frequency above about 19 kHz and below the lowest lamp resonant frequency. The ballast includes a soft start circuit for generating a gradual increase in the ignition voltage. A low voltage power supply 160 provides power to operate the control circuit upon circuit startup prior to oscillation of the inverter as well as during inverter oscillation. A stop circuit 150 senses when the discharge device 3 has extinguished, turns off the inverter stage and turns it back on to provide a pulsing start to allow reignition of the discharge device 3. The ignition pulses are provided for a nominal 50 ms, with a pulse repetition frequency of a nominal 400 ms.

Figure 4:
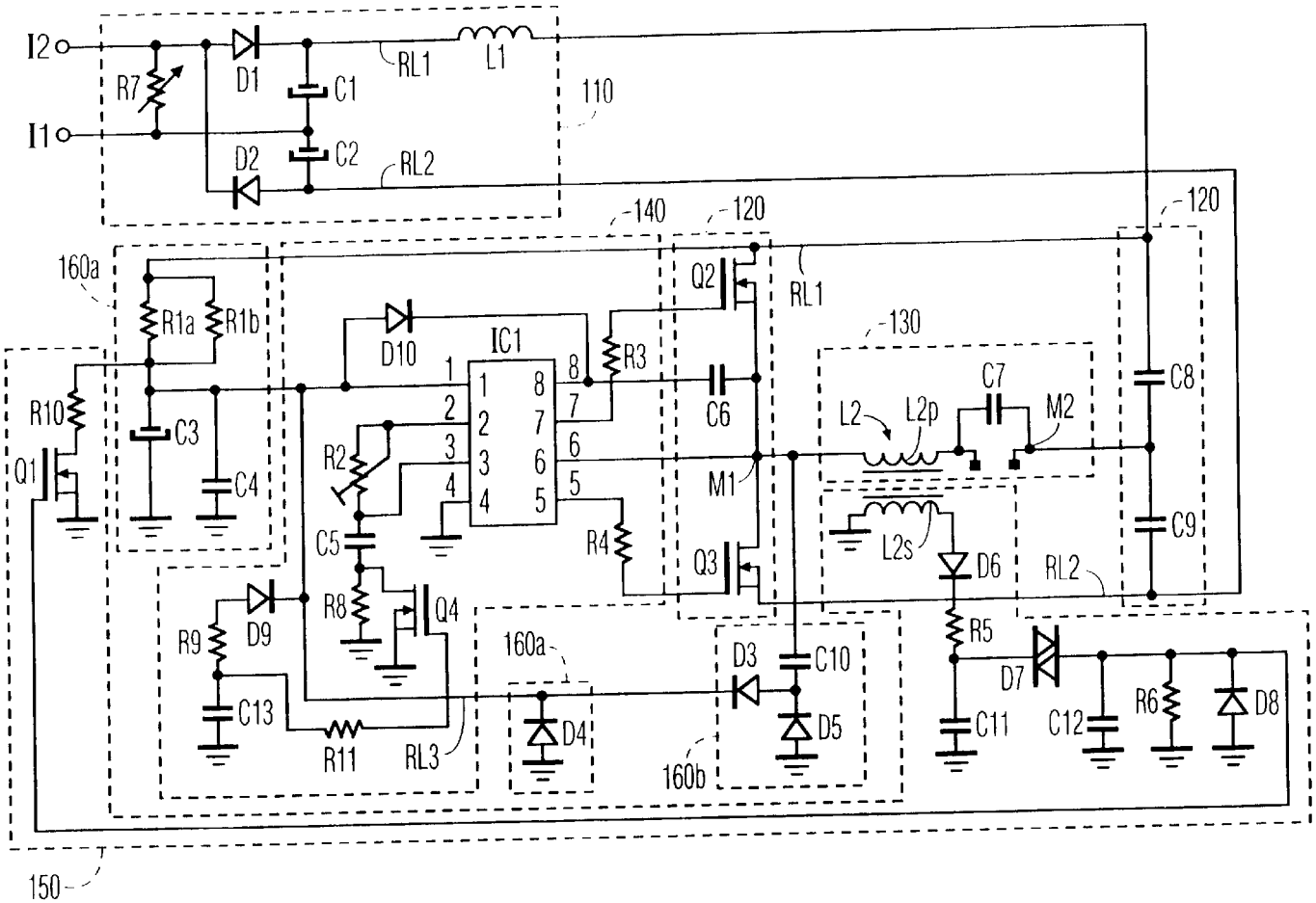
FIG. 4 is a circuit diagram of the high frequency ballast of FIG. 3.

As shown in FIG. 4, the DC source 110 includes a pair of input terminals I1, I2 for receiving a standard AC power line voltage of 110–120 V. A varistor R7 connected across the input terminals I1, I2 provides protection for the circuit against transients. A voltage doubler includes the diodes D1, D2 and the capacitors C1, C2. The voltage doubler provides a 120 Hz DC output of about 300 V on the DC rails RL1, RL2.

The inverter 120 is a half-bridge inverter with MOSFET switches Q2 and Q3 connected in totem pole fashion, i.e. connected in series across the DC rails RL1, RL2. The source of switch Q2 is connected to rail RL1, the drain of switch Q2 is connected to the source of switch Q3 and the drain of switch Q3 is connected to rail RL2. The control gates of switches Q2 and Q3 are connected to control circuit 140 in a manner to be further described. The half-bridge capacitors C8 and C9 are also connected in series across the rails RL1, RL2 and act as energy storage elements, and provide 150 V reference voltage for the network of the inductor L2 and the capacitor C7. The output of the half-bridge inverter, appearing across mid-points M1, M2, is a high frequency generally square wave signal.

The resonant output circuit 130 is of the LC type and includes the primary winding of inductor L2 connected in series with a starting capacitor C7 between the midpoints M1, M2. The resonant circuit is tuned to the third harmonic of the operating frequency. The discharge device 3 is connected at lamp terminals L1, L2, electrically in parallel with capacitor C7. The LC network provides a waveshaping and current limiting function to provide a lamp current to the discharge device 3 from the high frequency square wave inverter output present across the midpoints M1, M2.

The control circuit 140 controls the switching frequency and pulse width of the switches Q2, Q3 to provide the lamp current to discharge device 3 at a substantially constant frequency after lamp ignition. The heart of the control circuit is the 8 pin integrated circuit IC U1 (an IR 2151 from International Rectifier, for example). Pin 1 is the power input for IC U1. Pins 2 and 3 are coupled to a network which controls the inverter oscillation during steady-state operation as well as for providing ignition pulses to the discharge device 3. Pin 4 is connected to circuit ground. Pin 5 is connected to the control gate of switch Q3 via resistor R4. Pin 6 is connected to the midpoint M1 and provides the high side floating supply voltage. Pin 7 is connected to the control gate of switch Q2 via resistor R3. Pin 8 is connected to a node between the midpoint M1 and the drain of switch Q2 via a capacitor C6 and provides the high side supply voltage for switching switch Q2, and is charged via bootstrap diode D10 from the low voltage power supply.

The frequency of operation of the inverter is controlled at two different levels, which provides a soft-start feature for igniting the discharge device 3. The first and second levels are controlled by the switchable, soft start RC network of a resistor R2, a capacitor C5, a resistor R8 and a MOSFET switch Q4. When the switch Q4 is conductive, it shunts the resistor R8 so that the frequency is set at the second level by the RC time constant of the resistor R2 and capacitor C5. When the switch Q4 is non-conductive, the frequency is set at the first level by the RC time constant determined by the resistors R2, R8 in conjunction with capacitor C5. The switching of the switch Q4 is controlled by the network of a 7.5 V zener diode D9, a resistor R9 and the capacitor C13. The diode D9 has its cathode connected to the power supply line RL3 and its anode connected through the resistor R9 and the capacitor C13. The control gate of switch Q4 is connected to a node between the resistor R9 and the capacitor C13 via resistor R11 which dampens the turn-on of switch Q4.

During turn-on of the circuit an initial frequency is present—set by the resistors R2, R8 and capacitor C5—of around 28 kHz. This effectively detunes the network of L2 and C7 which has been tuned to the third harmonic (about 72 kHz) of the nominal operating frequency of about 24 kHz. Thus, the switches Q2 and Q3 are turned on into a non-resonant condition, and the current through these switches is significantly less than would be found at resonance. After approximately 10 ms, the charging time of diode D9, resistor R9 and capacitor C13, the switch Q4 is turned on and left on during steady state lamp operation. Switch Q4 shunts resistor R8, shifting the inverter frequency to the 24 kHz design range, which ignites the discharge device in a manner to be further described.

The integrated circuit IC U1 is powered by power supply 160 having two branches 160*a* and 160*b* providing a resistive startup at initial circuit turn on and a dv/dt supply providing power during operation, respectively. The branch 160*a* includes electrolytic capacitor C3, filter capacitor C4, and the resistors R1*a* and R1*b*. Capacitors C3 and C4 each have one end connected to circuit ground. The other end of capacitors C3, C4 are connected to rail RL1 via the parallel resistors R1*a*, R1*b* and to pin 1 of IC U1.

When line voltage is first applied to input terminals I1, I2, the electrolytic capacitor C3 is charged through parallel resistors R1*a*, R1*b* until the zener diode D9 turns on, at 7.5 V. The IC U1 will start switching at approximately 8.5 V. At this time capacitor C13 starts to charge via zener diode D9, and the soft start network is activated. The voltage across capacitor C13 increases until zener diode D4 conducts at 11 V. This now sets the supply voltage for operating IC U1. The zener diode D4 is in parallel with the capacitor C3 and clamps the voltage to which C3 charges to about 11 V, which appears at pin 1. During inverter oscillation, power is supplied to integrated circuit IC U1 by the dv/dt branch 160*b* which includes current-limiting capacitor C10 and rectifying diodes D5, D3. The capacitor C10 has one end coupled to the midpoint M1 and its other end connected to the cathode of a diode D5, the anode of which is connected to ground. The diode D3 has its anode connected at a node between the capacitor C10 and the diode D5 and its cathode connected to the cathode of diode D4 and the capacitors C3, C4 and pin 1. The capacitor C10 limits the AC current from the square wave present at the midpoint M1, while the diodes D3, D5 rectify the AC voltage to DC for input at pin 1, clamped at around 11 V by the diode D4. The supply branch 160*a* is capable of supplying about 1.9 ma and the supply branch 160*b* is capable of supplying about 4 ma.

The stop circuit 150 provides a pulse ignition voltage for 50 ms. The stop circuit includes MOSFET switch Q1, having its source connected to ground and its drain connected to pin 1 and the capacitor C3 via resistor R10. When switch Q1 is conductive, the capacitor C3 is discharged to ground through the resistor R10, which turns the integrated circuit IC U1 off by removing the power supply. Switch Q1 is ultimately controlled by the presence of an over voltage on the secondary winding $L2_s$ of inductor L2. This may occur during generation of the ignition pulses if the discharge device does not ignite or if the discharge vessel extinguishes during inverter oscillation. An overvoltage across the secondary winding $L2_s$ causes the capacitor C11 to charge through the diode D6 and the resistor R5. When the capacitor C11 is charged to a range between about 26 and 32 V, the diac D7 breaks down, charging capacitor C12 to a voltage clamped by the diode D8 to 15 V, and rendering the switch Q1 conductive. Capacitor C12 discharges through the resistor R6, with the RC time constant of the resistor R6 and capacitor C12 controlling how long the switch Q1 remains conductive, and consequently how long the integrated circuit IC U1 remains off.

Figure 5A:
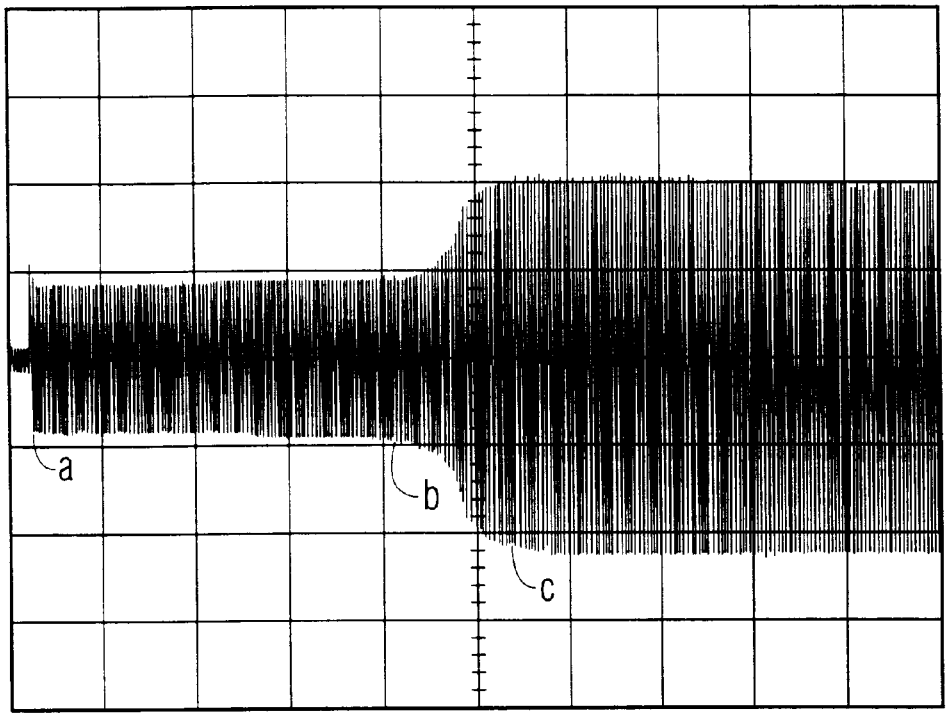
FIG. 5(*a*) illustrates a "soft start" feature of the ballast.
Figure 5B:
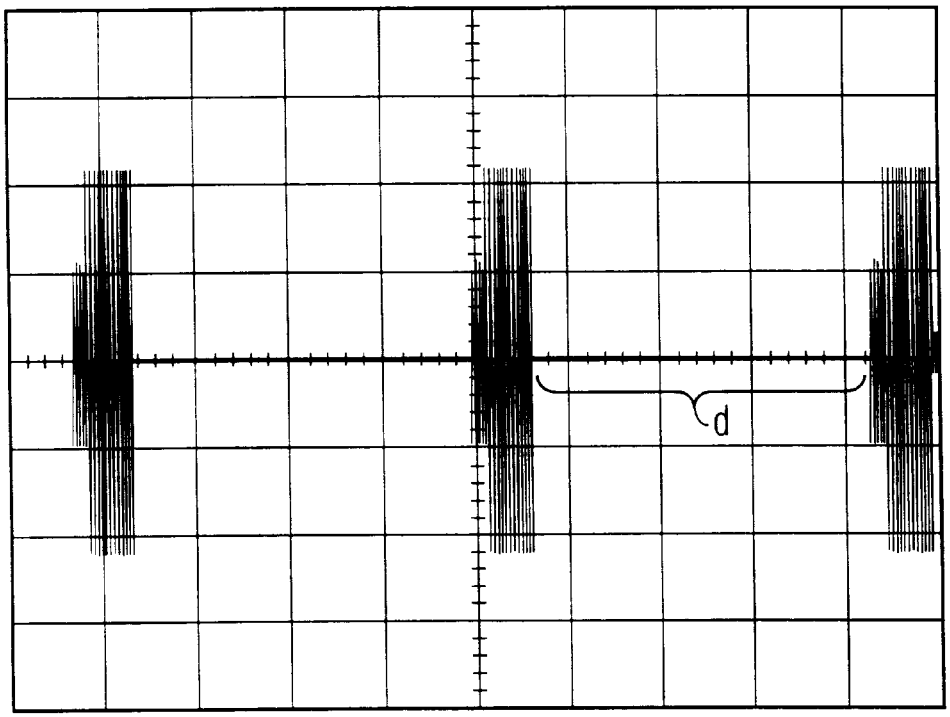
Figure 6A:
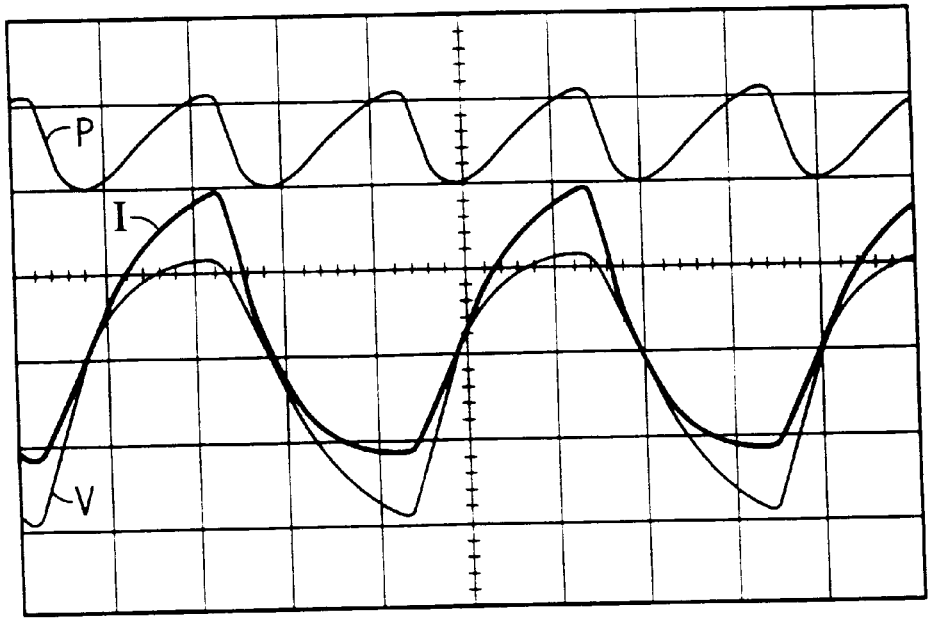
FIG. 6(*a*) illustrates the steady-state lamp power, current and voltage waveforms.
Figure 6B:
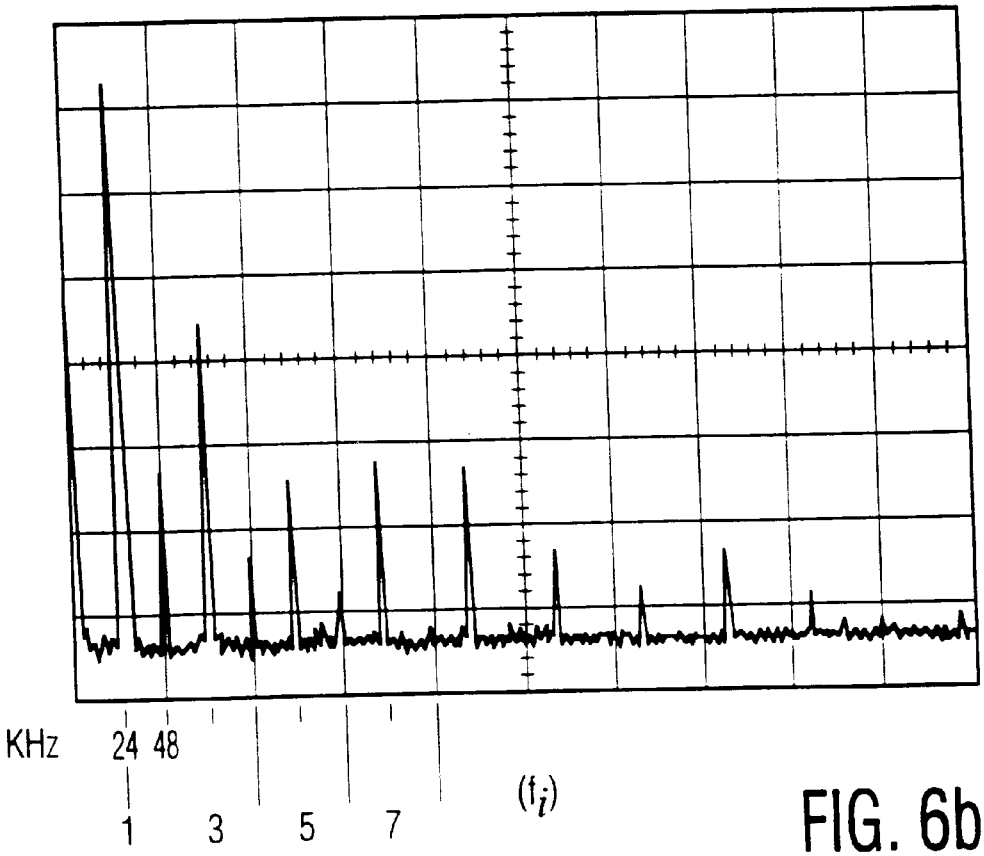
Figure 6C:
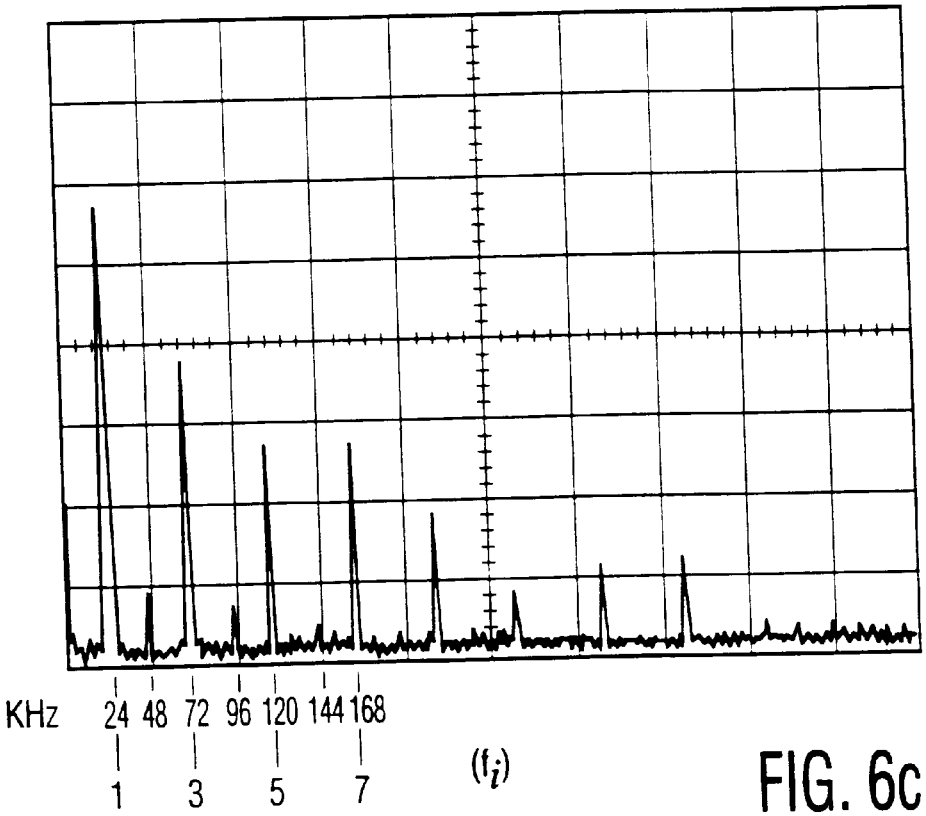
Figure 6D:
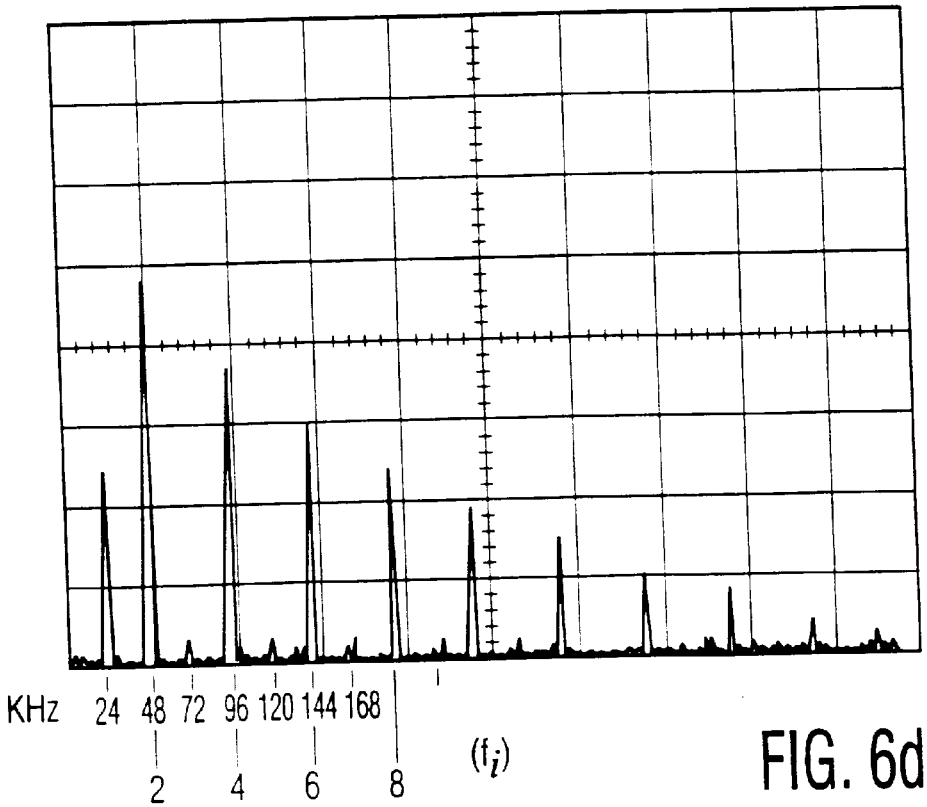

The soft start and recurrent ignition features are illustrated in FIGS. 5(*a*) and 5(*b*). Each ignition pulse sequence starts at an initial voltage of about 400 V peak (ref. "a") and ramps up to a 1200 V peak ignition voltage (ref. "c") for igniting the discharge lamp. The initial voltage is generated when the inverter frequency is at 28 kHz. This state occurs for about 10 ms, until R9 and C13 are charged to the threshold voltage of switch Q4, in this case about 2 V. The switch Q4 takes a finite time, set by the resistor R9 and the capacitor C13 to turn fully on. During this finite time, the resistor R8 is gradually shunted, causing a gradual reduction from the initial 28 kHz frequency to the nominal 24 kHz frequency over a time period of about 40 ms. This frequency shift provides the soft ramp-up in voltage denoted by ref. "b". The nominal 24 kHz provides the 1200 V peak ignition voltage.

After about 50 ms at 1200 V peak, the time constant of resistor R5 and capacitor C11 causes diac D7 to breakdown, the stop circuit 150 turns the IC U1 off, stopping the ignition pulses (ref "d"). After approximately 400 ms (ref "c"), the resistor R6 discharges capacitor C12, opening switch Q1.

This returns power to the IC U1 via resistive supply branch 160*a*, beginning the ignition pulse sequence again. (FIG. 5(*b*)) Consequently, the circuit provides a soft start as well as recurrent ignition pulse sequences.

FIG. 6(*a*) shows the steady state waveforms for the lamp power (P), current (I) and voltage (V) for the above 20 W discharge device operated on the above described ballast. FIGS. 6(*b*), 6(*c*) and 6(*d*) are fast fourier transforms illustrating the harmonic content of the lamp voltage, current and power waveforms of FIG. 6(*a*), respectively. In these FIGS. 6(*b*)–(*d*), the scale for each vertical division is 10 dB. The fourier equations for the lamp voltage, current and power are:

$$V(t)=V_1 \cos(2\pi f_1 t)+V_3(\cos 2\pi f_3 t)+V_i(\cos \pi 2 f_i t)+\ldots;$$

$$I(t)=I_1 \cos(2\pi f_1 t)+I_3(\cos 2\pi f_3 t)+I_i(\cos \pi 2 f_i t)+\ldots; \text{ and}$$

$$P(t)=V(t)*I(t)$$

where the subscript 1 represents the fundamental of the voltage and current and the subscripts 3 and i represent the third and odd $i^{th}$ harmonic, respectively, of the voltage and current.

After multiplying and simplifying, the power equation becomes:

$$P(t)=A+B \cos(2\pi(2f_1)t)+C \cos(2\pi(4f_1)t)+D \cos(2\pi 6 f_i)t) \ldots$$

Thus, the lamp power has a fundamental at twice the fundamental frequency of the lamp current and voltage, and harmonics at 4,6,8 etc. times the fundamental frequency of the lamp current and voltage. This is clearly shown in FIG. 6 (*d*) in which the fundamental of the power frequency, in this case 48 kHz, is twice the frequency of the fundamental of the lamp current and voltage, in this case 24 kHz. The third harmonic of the current waveform at 72 kHz, was only 11%–12% of the 24 kHz fundamental frequency. The first harmonic of the power frequency is at 96 kHz but is only about 10% of the magnitude of the fundamental power frequency. With these levels of harmonics in the current and power waveforms, no acoustic resonance was observed. Thus, the disclosed circuit and discharge device show that it is possible to drive an HID discharge device with a signal which differs substantially from a pure sinusoidale waveform while avoiding acoustic resonance. Those of ordinary skill in the art will appreciate that other circuits with a more closely sinusoidal lamp current and voltage are possible, which will have lower harmonic content and also be suitable for driving the discharge device at a frequency below the lowest lamp resonant frequency. Such a more closely sinusoidal waveform may be provided by a push-pull circuit, known for example, from U.S. Pat. Nos. 4,484,108 and 4,463,286.

Lamp Efficacy: Photometrics

The above described PAR 38 embodiment has a system wattage of 22 W, with the lamp consuming about 20 W and the ballast having losses of about 2 W. Table 1 compares the photometric and colormetric parameters of this lamp (INV.) with that of a commercially available 90 W Halogen PAR 38 and a 60 W PAR 38 with a halogen IR burner. Also shown are the photometric parameters of two known blown glass reflectors, or "R", lamps, an 85 W VR40 and a 120 W VR40. The data for the above-described lamps according to the invention were based on a group of 20 samples. The light emitted by the sample lamps had correlated color temperature (CCT) of 3000 K and a color rendering index (CRI) of >85. The luminous efficacy of the lamp was 60 LPW. As compared to the known 60 W PAR 38 lamp with a halogen IR burner, the luminous efficacy was 233% better, and 314% better with respect to the 90 W halogen PAR 38. Additionally, the discharge device is expected to have a life of about 10,000 hours, which is 3 to 4 times that of the known 60 W halogen IR and 90 W halogen PAR 38 lamps.

TABLE I

| LAMP | POWER (W) | LUMENS | EFFICACY (LPW) | MBCP, SPREAD (Flood) (cd), Degrees | CCT K | CRI |
|---|---|---|---|---|---|---|
| INV. | 22 | 1320 | 60 | 4000, 28 | 3000 | 85–87 |
| 90 W | 90 | 1280 | 14.5 | 4500, 28 | 2900 | 100 |
| 60 W IR | 60 | 1100 | 18 | 3650, 29 | 2800 | 95 |
| 85WVR40 | 85 | 925 | 10.9 | | | |
| 120WVR40 | 120 | 1150 | 9.6 | | | |

Accordingly, it is clear that the integrated lamp is superior to the commercially available halogen and halogen IR PAR lamps and the incandescent blown glass reflector lamps with respect to life and luminous efficacy. Additionally, by altering the fill of the discharge device with known metal halide technology, the lamp designer has greater control over the photometric parameters as compared to a lamp generating light with an incandescent filament, in particular with respect to the correlated color temperature.

A significant advantage of the use of a metal halide discharge device with a ceramic wall, and at low wattages, is the significant colorimetric uniformity (a) relative to burning position and (b) from lamp-to-lamp. This uniformity is believed to be due to the small physical size which leads to more uniform thermal properties in the lamp fill during operation and the tight dimensional tolerances to which the ceramic material can be held during high speed manufacturing, which provides the lamp-to-lamp uniformity. It has been found that ceramic discharge vessel dimensions can be held to better than 1% (six sigma) whereas for conventional quartz arc tube technology the dimensions can only be held to about 10%.

Figure 7A:
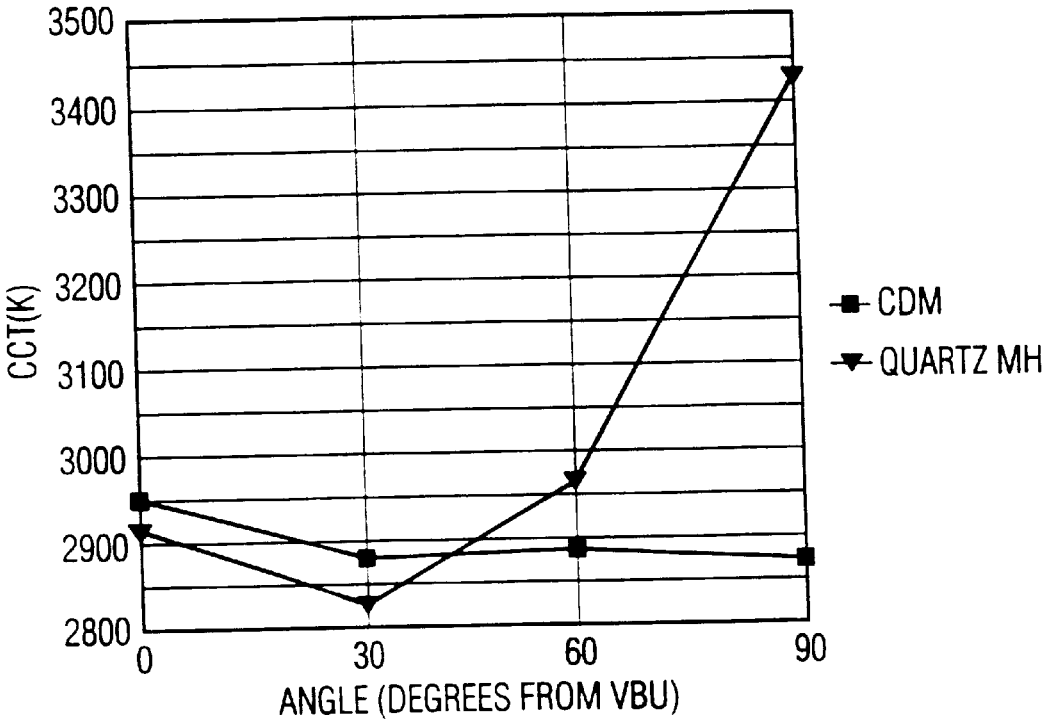
FIGS. 7(*a*) and 7(*b*) are graphs illustrating the superior stability in correlated color temperature (CCT) and color rendering (CRI) of a metal halide lamp with a ceramic arc tube versus a quartz arc tube.
Figure 7B:
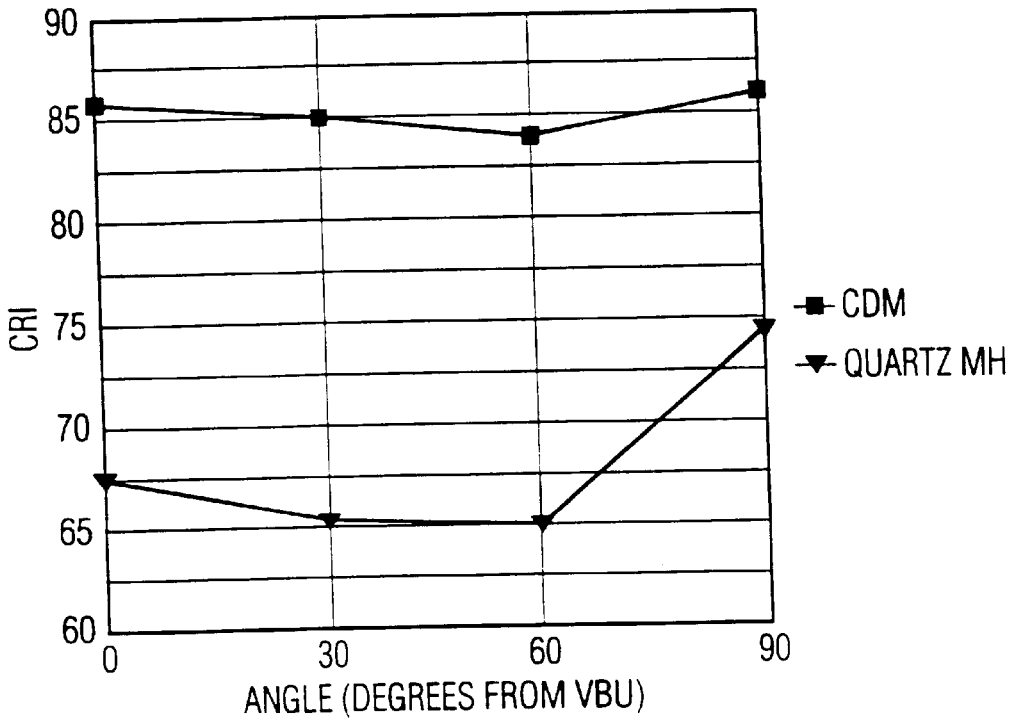

FIGS. 7(*a*) and 7(*b*) are graphs of CCT and CRI, respectively, for a typical low wattage ceramic metal halide (CDM) lamp and a typical quartz metal halide lamp as a function of burning position, indicated as degrees from the vertical, base up (VBU) burning position. For CCT, the CDM lamp had only a variation of 75 K versus a variation of about 600 K for the quartz lamp, over the range 0–90 degrees from VBU. Likewise, for CRI, the CDM lamp had a variation of only about 2.5 CRI versus about 10 CRI for the quartz metal halide lamp.

Additionally, with respect to lamp-to-lamp color stability, a low wattage metal halide with a ceramic discharge vessel typically exhibits a standard deviation of 30 K in color temperature. For low wattage metal halide lamps with quartz arc tubes, the standard deviation is much greater, 150–300 K. The much narrower spread in color temperature is important because it makes the integrated lamp with the ceramic metal halide discharge device an acceptable replacement for halogen PAR lamps for indoor and retail lighting. In effect, when many reflector lamps with the ceramic discharge device are used, for example in a ceiling, they will appear to be substantially uniform, unlike quartz metal halide lamps in which the observer would clearly notice the non-uniformity among the lamps.

Figure 8:
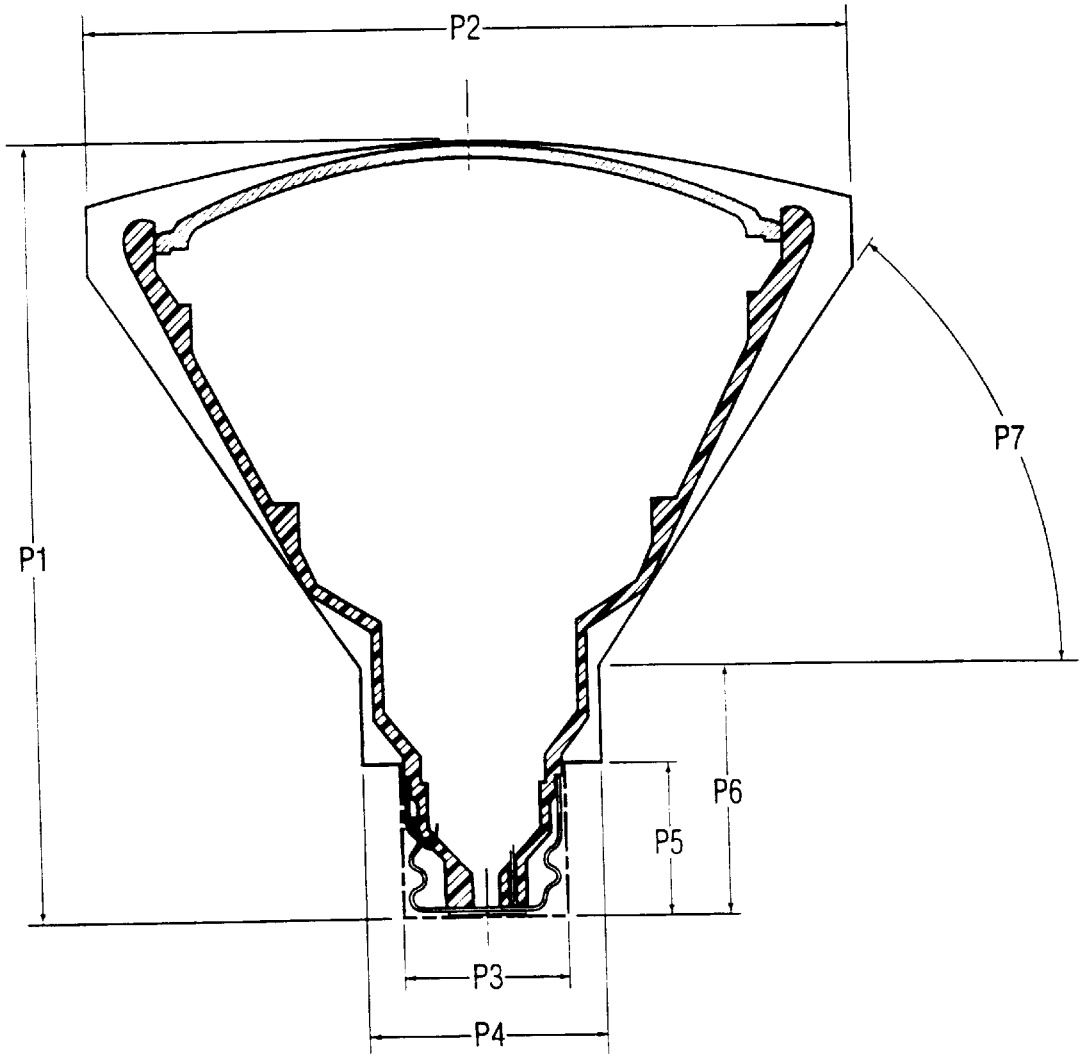
FIG. 8 illustrates the outline of a PAR 38 integrated HID lamp according to the invention superimposed over the ANSI specified PAR 38 outline.

A critical aspect of the integrated lamp according to the invention is that these improvements were achieved in an overall outline which substantially fits within that of the outline for the corresponding lamp type; in the embodiment shown within the ANSI specification for a PAR 38 lamp. This allows the integrated PAR 38 HID lamp to be retrofit into all fixtures designed to physically accept a conventional PAR 38 lamp. FIG. 8 shows the outline of the lamp of FIG. 1 superimposed over the ANSI specified outline for a PAR 38 lamp. The dimensions (mm) are: P1=135; P2=135; P3=28.2; P4=40.4; P5=26.8; P6=48.8 and P7=540.

Several features facilitate this packaging. The first is the use of small, compact HID light source having a small overall length. The overall length of the 20 W arc tube was 22 mm. The small overall length permits the arc tube to be positioned transversely within a reflector body which is nested in an outer shell having a maximum rim diameter within that of the ANSI specification. In this PAR 38 embodiment, the sealed reflector envelope 227 is a PAR 36 envelope and has an inside diameter measured at the rim 231 of 96 mm. The outside diameter is about 110 mm. The transverse mounting also permits the use of an axially shallow reflector body, leaving sufficient room for the ballast.

The use of a pressed glass reflector body with a comparatively thick rear wall in conjunction with the reflective coating on the rear wall provides acceptable thermal insulation, preventing excessive heating of the ballast by radiant energy from the discharge device. In this case, the minimum thickness of the reflector body at the basal portion was 3 mm. Additional thermal protection is provided by the outer periphery of the circuit board being tightly seated against the shoulder 245, which effectively retards air circulation from the warmer first compartment "A" adjacent the reflector to the second compartment "B" between the circuit board and the base. Temperatures measured in the interior of the shell during base-up operation were sufficiently low so as to ensure a circuit life comparable to that of the discharge device 3. Generally, the maximum circuit temperatures should be below 100° C. In the lamp described above, the temperature measured at the reflector side of the circuit board 320 was 83° C. while the temperature on the ballast component side was 75° C. The air temperature in the compartment B between the circuit board and the shell at the ballasts side was 74° C. The highest circuit component temperature was 81° C.

The thermal regulation of the discharge device 3 within a gas filled, thick walled pressed glass envelope and surrounded by a sleeve aids in controlling photometrics, which allows a greater range of ambient conditions in which the lamp can be operated without the photometrics noticeably shifting.

The small physical size of the discharge vessel, along with the L:ID dimensions on the order of 1:1, was also important for reducing the size of the ballast. Since the discharge device has a lowest acoustic resonant frequency at about 30 kHz on a current basis, there is a sufficient window in which the ballast can operate above 19 kHz and at a constant frequency during lamp operation. High frequency operation is important because it provides reduced physical size of the inductive elements of the ballast. Operating at a fixed frequency provides simple control of the ballast inverter, thus reducing size (and cost).

In FIG. 1, the discharge device 3 is in a gas filled envelope 227 surrounded by a quartz glass sleeve 243 supported by straps connected to the leads 240, 241. According to another embodiment, the discharge device 3 is enclosed by a capsule 400 in a gas-tight manner. (FIG. 9) In this case, the discharge leads 40, 50 extend through the capsule and are supported by the leads 240, 241. Such a sealed capsule also provides thermal control of the discharge device 3.

A primary reason that the envelope 227 is sealed is to protect the leads 40, 50 and 240, 241 from oxidation. Instead of a glass bonded seal at the rim 231, a less than hermetic seal, such as an epoxy seal could be used if the leads are protected with an anti-oxidation coating.

Figure 9:
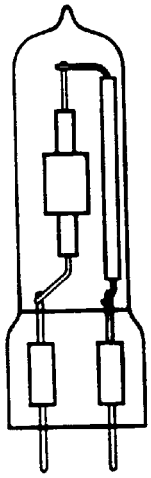
FIG. 9 illustrates the discharge device 3 enclosed in a gas-tight capsule.

Additionally, with adequate thermal control, such as with a discharge devices sealed in a capsule as in FIG. 9 and/or with a discharge device of lower rated power, an HID reflector lamp fitting within the outline of a corresponding lamp may also be obtained with a reflector body of other than glass, such as for example a high temperature plastic with a reflective coating, such as, for example, of aluminum or silver deposited thereon, or applied, for example, as a mylar sheet. The reflector body/surface may form an integral part of the shell.

Figure 10:
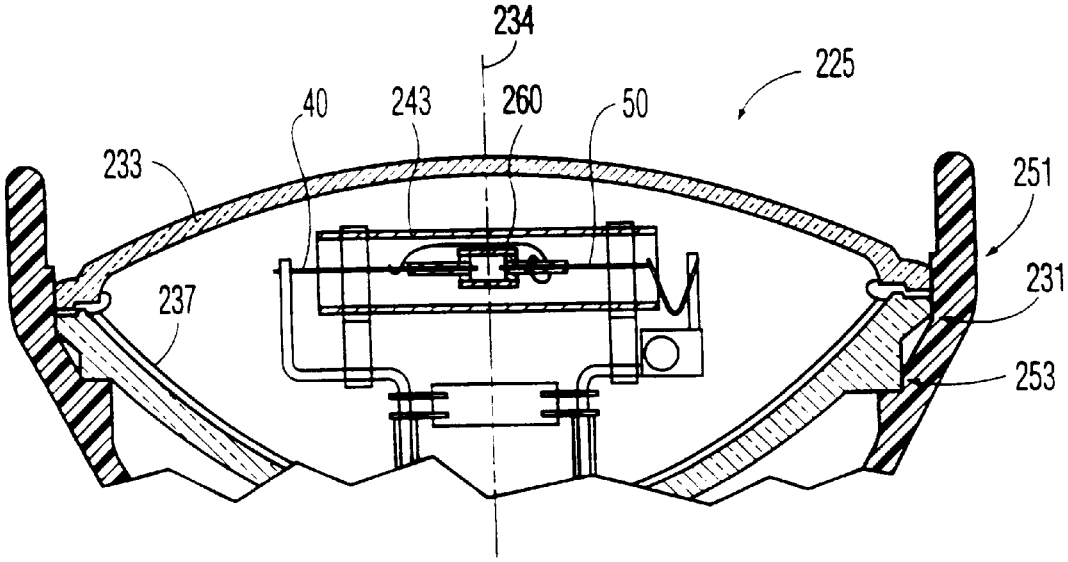
FIG. 10 is a cross-section, partly cut away, showing the shell extending past the lens to reduce glare.

FIG. 10 shows an alternative embodiment in which the rim of the shell 251 extends axially past the discharge device 3 to reduce glare from the discharge device.

Figure 11A:
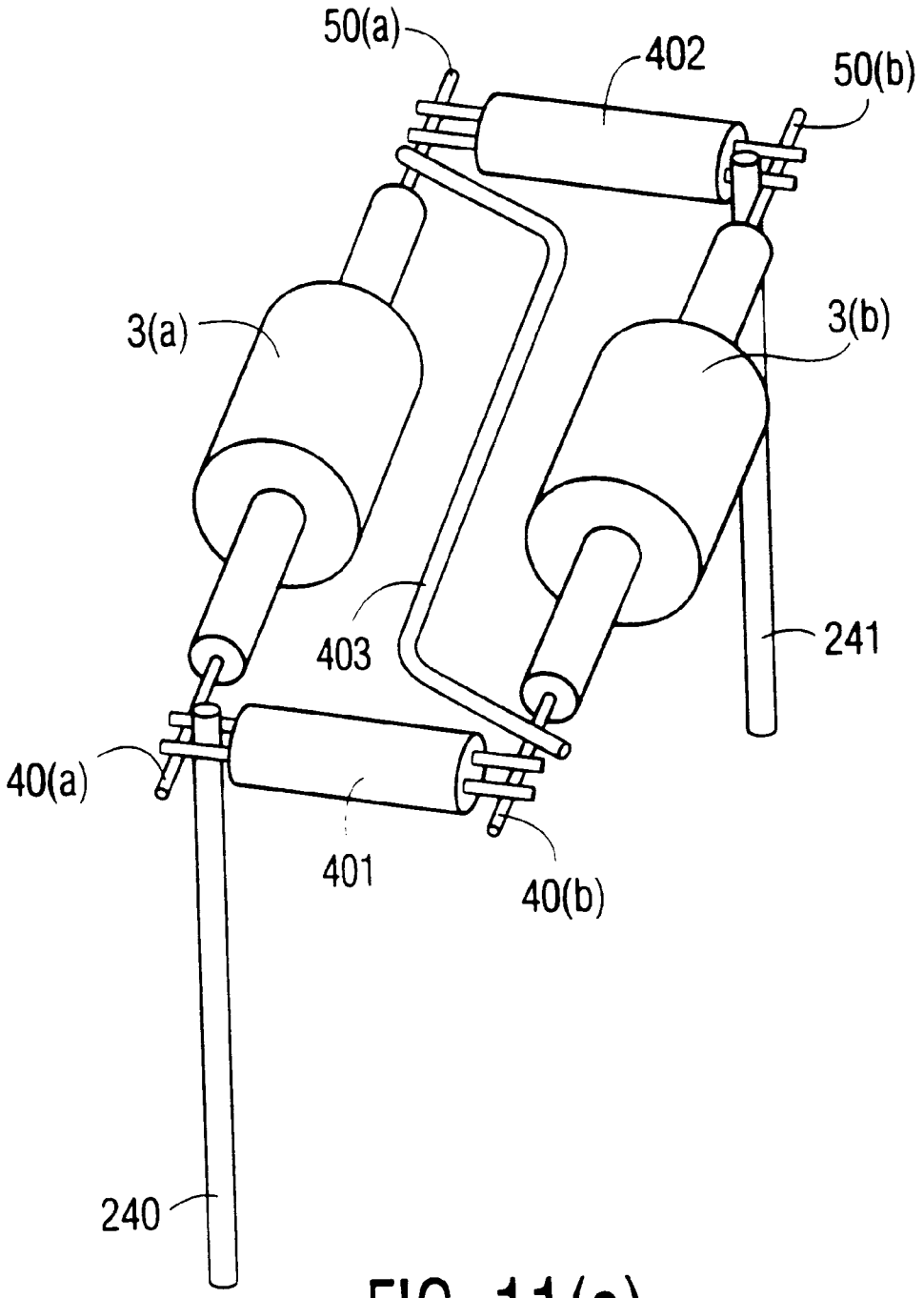
FIG. 11(*a*) illustrates a mount construction for two discharge devices in series.
Figure 11B:
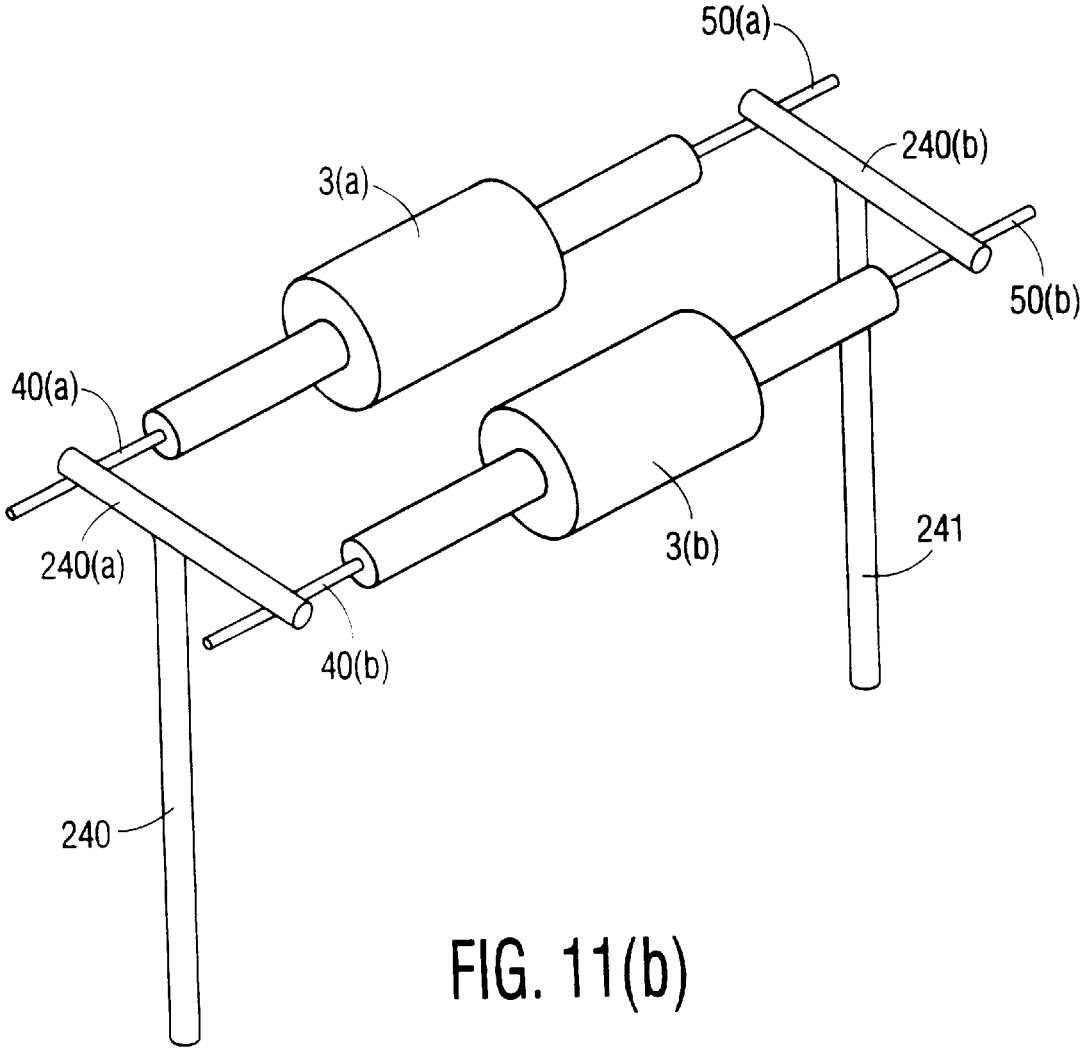

FIG. 11(*a*) shows a mount construction for a plurality (in this case two) of discharge devices 3 electrically in series within a reflector body, such as shown in FIG. 1. Components corresponding to those shown in FIG. 1 have the same reference numbers. The discharge device 3(*a*) has one lead 40(*a*) fixed to lead 240 while device 3(*b*) has one lead 50(*b*) connected the other lead 241. The series connection is completed by conductive element 403 bridging leads 50(*a*) and 40(*b*) of the discharge devices 3(*a*); 3(*b*). The elements 401, 402 are non-conductive and provide additional mechanical support. The ignition aid 260 is not shown for purposes of clarity. With two arc tubes operated concurrently, the lamp provides approximately twice the light output. Each arc tube has its lowest resonant frequency above 30 kHz, so with the ballast providing lamp current at a nominal 24 kHz, there is no danger of inducing acoustic resonance. It should be noted that a single discharge device having a rated wattage of 40 W, the same as the two 20 W discharge devices, would have its lowest lamp resonant frequency significantly lower than that for each of the two 20 W arc tubes, either much closer to 19 kHz or below 19 kHz. Accordingly, by using two discharge devices the large resonance free operating window above about 19 kHz is retained while the benefit of more light output of a higher wattage lamp is obtained. While two arc tubes are shown, concurrent operation of more than two discharge devices is possible, so long as the circuit is modified to provide the correct ignition and operating voltage for the lamps. Other ignition aids, such as a well known UV enhancer, may alternatively be incorporated in the lamp to improve ignition characteristics.

FIG. 11(*b*) shows a mount construction for a pair of discharge devices 3(*a*), 3(*b*) connected electrically in parallel. In this case, the leads 240, 241 have respective conductive cross-bars 240(*a*), 241(*a*) electrically connected to respective ones of the leads 40(*a*), 40(*b*); 50(*a*); 50(*b*) and mechanically supporting the discharge devices 3. Such a parallel arrangement effectively doubles the life of the lamp, since only one arc tube will ignite and generate light due to the slight differences in impedance between the discharge devices. At the end of life of one discharge device, the other one will take over. This also provides instant restrike capability. If the operating discharge device extinguishes because of a power interruption, for example, its impedance due to its elevated temperature may be sufficiently high so as not to ignite. However, the other discharge device which was not previously operating will have a significantly lower temperature and will readily ignite.

Figure 12:
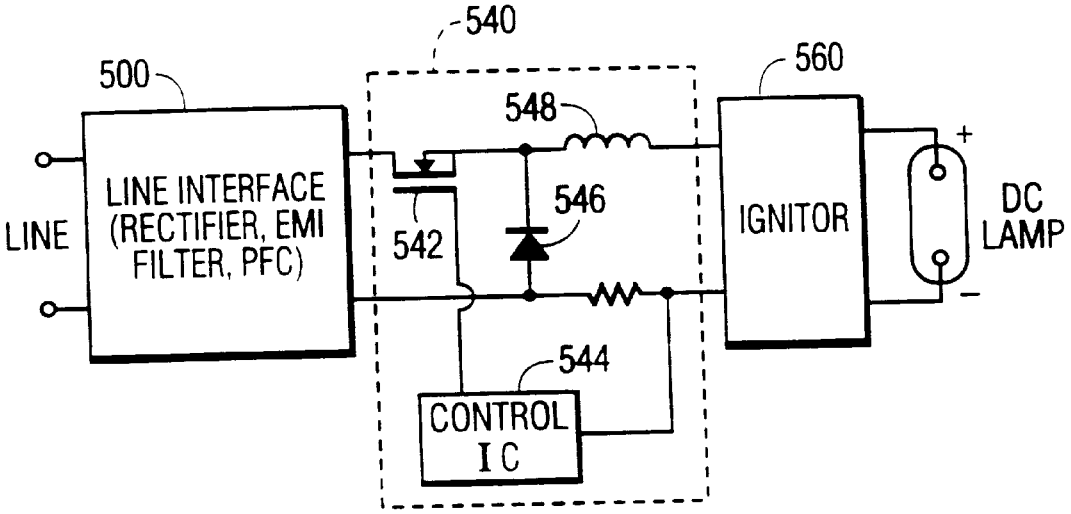
FIG. 12 is a schematic of a DC ballast for operating a discharge device 3.

An integrated HID reflector lamp fitting within the corresponding ANSI specified PAR outline may alternatively include a discharge device operated on DC provided by a DC ballast located within the shell. The DC ballast (FIG. 12) includes a line interface circuit 500, a down converter circuit 540 and an ignitor circuit 560. The interface circuit includes inputs for receiving an AC input voltage, such as from a utility line. The interface circuit includes a rectifier, and may also include an EMI filter and a power factor correction circuit, as are known in the art. The output of the line interface circuit is a DC signal supplied to the down converter 540 on line HV+. The down converter 540 includes a switch 542 whose control gate is controlled by a control integrated circuit 544, an inductor 548 connected in series with the switch and a diode 546. The control IC senses the lamp current from the discharge device 3 and controls the duty cycle of the switch 542 to control the current to the discharge device 3 with a constant polarity. By varying the value of the inductor, the switching frequency and the time that the switch is conductive, the DC current through the inductor 548 and thus the load current through the lamp can be cotnrolled at a suitable level. The ignitor 560 provides a sufficient voltage to ignite the discharge device 3 upon initial circuit turn on. The ignitor 560 may be a pulse ignitor, for example. Integrated circuits for sensing the lamp current and driving the switch 542 are commercially available. One example is a unitrode UC 3524.

An advantage of DC operation is the complete avoidance of acoustic resonance and its simplicity. However, a disadvantage is that the discharge device operated on DC is more sensitive to changes in color with changes in operating position and is susceptible to salt migration.

HID lamps with ceramic discharge devices are shown and described with respect to FIG. 1 have shown acceptable colorimeteric and photometric out through 5000 hours of operation.

While there has been shown to be what is considered by the inventors to be the preferred embodiment of the invention, those of ordinary skill in the art will appreciate that various modifications may be made to the above described lamp which are within the scope of the appended claims. For example, the shell and reflector unit could be provided with a disconnectable electrical contact to allow the reflector unit to be replaced, for example, if the ballast is designed to have a longer life than the discharge device. Furthermore, while a discharge device with electrodes has been shown, the benefits regarding discharge device size, material and shape with respect to acoustic resonance would be applicable to an electrodeless lamp. Additionally, for DC operation, a conventional quartz glass discharge vessel could be used since acoustic resonance is not problematic with DC operation. Other suitable DC circuits are known in the art for gas discharge devices as can be used. Accordingly, the specification is considered to be illustrative only and not limiting.

What is claimed is:

1. An integrated HID reflector lamp for retrofitting a corresponding incandescent reflector lamp comprising an incandescent filament, a reflector body and a screw base, the reflector lamp having a prescribed outline, total lumens and luminous efficacy, said HID reflector lamp comprising:

a shell having a wall enclosing an internal volume, said wall having a circumferential rim portion defining a light emitting opening of said shell and an opposing basal portion, said shell generally tapering with increasingly smaller diameter from said rim portion to said basal portion, a screw base secured on said basal portion, a high pressure arc discharge device arranged relative to said shell, a reflective surface positioned within said shell for reflecting light emitted by said discharge device out through said light emitting opening, and a ballast within said shell body for energizing said discharge device to emit light, said ballast including input terminals connected to said screw base and output terminals connected to said discharge device, said ballast being responsive, when an operating voltage from an ordinary electric utility line that normally powers said incandescent reflector lamp is applied to said shell on said screw base, to ignite and maintain a gas discharge within said discharge device, said integrated HID lamp having an outline substantially entirely within the outline of the corresponding reflector lamp, and having total lumens at least substantially equal to and a luminous efficacy substantially greater than the corresponding reflector lamp.

2. An integrated HID reflector lamp according to claim 1, further comprising a sealed envelope of pressed glass enclosing said discharge device in a gas-tight manner and comprising said reflective surface, said reflective surface defining an optical axis and said sealed envelope having a largest internal diameter transverse to said optical axis, said discharge device being arranged transverse to said optical axis.

3. An integrated HID lamp according to claim 2, said sealed envelope having an outer diameter of about 110 mm, and said shell, with said threaded base, said sealed envelope and said ballast received in said shell, having an outline substantially within that of the ANSI outline for a PAR 38 lamp.

4. An integrated HID reflector lamp according to claim 3, wherein said lamp emits total lumens of at least about 1100 lumens.

5. An integrated HID reflector lamp according to claim 4, wherein said lamp has luminous efficacy of at least about 60 LPW.

6. An integrated HID reflector lamp according to claim 5, wherein said discharge device has a fill of a buffer, a metal halide and a rare gas.

7. An integrated lamp according to claim 2, wherein said shell comprises a synthetic resin material.

8. An integrated lamp according to claim 1, wherein said shell comprises a synthetic resin material.

9. An integrated HID reflector lamp according to claim 1, wherein said lamp has an outline substantially within the ANSI outline for a PAR 38 lamp.

10. An integrated HID reflector lamp according to claim 1, wherein said discharge device has a rated power of about 20 W.

11. An integrated HID reflector lamp according to claim 10, wherein said lamp emits total lumens of at least about 1100 lumens.

12. An integrated HID reflector lamp according to claim 10, wherein said lamp has luminous efficacy of at least about 60 LPW.

13. An integrated HID reflector lamp according to claim 10, wherein said discharge device has a fill of mercury, a metal halide and a rare gas.

14. An integrated HID reflector lamp according to claim 1, wherein said discharge device has a lowest lamp resonant power frequency greater than about 38 kHz, said ballast operates said discharge device with a fundamental power frequency and with harmonies which are integer multiples of the fundamental power frequency, said fundamental power frequency being greater than about 38 kHz and lower than the lowest lamp resonant power frequency, and said harmonics above said lowest lamp resonant frequency having amplitudes which are insufficient to induce acoustic resonances.

15. An integrated HID reflector lamp according to claim 14, wherein said discharge device comprises a ceramic wall.

16. An integrated lamp according to claim 14, wherein said discharge space has a lowest longitudinal acoustic resonance frequency and a lowest azimuthal/radial acoustic resonance frequency, said discharge space being dimensioned such that said lowest longitudinal acoustic resonance frequency and said lowest azimuthal/radial frequency are substantially the same.

17. An integrated HID reflector lamp according to claim 16, wherein said discharge device has a rated power of about 20 W.

18. An integrated HID reflector lamp according to claim 1, wherein said ballast comprises switching means for providing a current through the discharge vessel having a constant polarity.

19. An integrated HID reflector lamp according to claim 18, wherein said discharge device comprises a ceramic wall.

20. An integrated lamp according to claim 19, wherein said ballast maintains said fundamental frequency substantially constant during steady state lamp operation.

21. An integrated lamp according to claim 20, wherein said discharge vessel includes a central circular-cylindrical zone with substantially planar end walls, said end walls being spaced by an axial distance L, said central zone having a substantially constant inner diameter ID over said distance L, and the ratio L:ID is about 1:1.

22. An integrated reflector lamp according to claim 21, wherein said lamp has an outline fitting substantially within the ANSI specified outline for a PAR 38 lamp.

23. An integrated lamp according to claim 22, wherein said lamp has luminous efficacy of at least about 60 LPW.

24. An integrated lamp according to claim 23, wherein said discharge device has a fill of a buffer, a metal halide and a rare gas.

25. An integrated lamp according to claim 24, wherein said dimensions L and ID are each about 3 mm.

26. An integrated, high frequency metal halide reflector lamp, comprising:

a) a sealed reflector unit comprising a reflector envelope comprising a pressed glass reflector body having a basal portion, a parabolic reflector surface extending from said basal portion and terminating at a circumferential rim of said reflector body, a light reflective material on said reflector surface, said reflector surface having an optical axis and a focus on said optical axis, and a light transmissive lens hermetically sealed to said rim of said reflector body, a metal halide discharge device comprising a discharge vessel of ceramic material enclosing a discharge space, an ionizable fill comprising mercury, a metal halide and a rare gas within said discharge space, a pair of discharge electrodes within said discharge space and between which a discharge is maintained during lamp operation, and a respective current conductor extending from each discharge electrode to the exterior of said discharge vessel in a gas-tight manner, said discharge device having a major axis, said discharge device being positioned with said major axis transverse to said optical axis and with said discharge space between said electrodes coinciding with said optical axis, and b) a shell of synthetic resin material having a circumferential rim portion receiving said rim of said reflector body and a base portion for receiving a lamp base, said shell generally tapering from said rim portion towards said base portion;

c) a lamp base on said base portion of said shell and having a pair of lamp contacts; and d) a ballast within said shell between said sealed reflector unit and said lamp base for energizing said discharge lamp to maintain a gas discharge between said discharge electrodes, during normal lamp operation said discharge device being free of acoustic resonances at alternating lamp currents below a lowest lamp resonant frequency, and the ballast circuit energizes the discharge lamp so as to have an alternating lamp current having a fundamental frequency and harmonics which are integral multiples of the fundamental frequency, the fundamental frequency and the lowest lamp resonant frequency are greater than about 19 kHz, and the harmonics above the lowest lamp resonant frequency have amplitudes which are insufficient to induce acoustic resonance.

27. An integrated lamp according to claim 20, wherein said discharge device has a lowest longitudinal acoustic resonance frequency and a lowest azimuthal/radial acoustic resonance frequency, said discharge space being dimensioned such that said lowest longitudinal acoustic resonance frequency and said lowest azimuthal/radial frequency are substantially the same.

28. An integrated reflector lamp according to claim 20, wherein said lamp has an outline fitting substantially within the ANSI specified outline for a PAR 38 lamp.

29. An integrated lamp according to claim 20, wherein said lamp has luminous efficacy of at least about 60 LPW.

30. An integrated lamp according to claim 20, wherein said discharge device has a fill of mercury, a metal halide and a rare gas.

31. A reflector lamp comprising a light source energizeable for emitting light, a reflector body having a reflective surface for directing light emitted by said light source, and a lamp base having lamp contacts electrically connected to a light source capsule, characterized in that:

said light source is a high pressure gas discharge device, and the lamp further comprises a pressed glass lamp envelope sealed in a gas tight manner and enclosing the high pressure gas discharge device, the pressed glass lamp envelope including said reflector body having said reflective surface, (i) a shell having a first end portion carrying said lamp base and a second end portion receiving said lamp envelope;

(ii) a ballast for energizing said discharge device to emit light, said ballast being mounted within said shell between said pressed glass lamp envelope and said first end portion, said ballast including a pair of input terminals each electrically connected to a respective contact on said lamp base and a pair of output terminals each electrically connected to a respective one of said current conductors of said discharge device; and (iii) said lamp envelope being received at said second end portion with said reflective surface positioned to reflect light and heat generated by said discharge device away from said ballast.

32. A reflector lamp according to claim 31, wherein said reflector body carrying said reflective surface has a thickness of greater than about 3 mm.

33. A reflector lamp according to claim 31, wherein said ballast includes a circuit board having a first side and a second side carrying circuit components of said ballast, said circuit board being mounted within said shell with said first side facing said reflector body and with said second side facing said lamp base, said circuit board defining a first compartment within said shell between said reflector body and said circuit board and a second compartment between said circuit board and said lamp base, and said circuit board being substantially imperforate and being secured to said shell to substantially completely retard communication of air between said first compartment and said second compartment within said shell.

34. A reflector lamp according to claim 31, wherein said reflective surface defines an optical axis, said discharge device includes discharge electrodes defining a major axis of the discharge device, the discharge device being arranged with said major axis transverse to and substantially coincident with said optical axis.

35. A reflector lamp according to claim 31, wherein said shell consists of a synthetic material.

36. A reflector lamp according to claim 31, wherein during normal lamp operation said discharge device is free of acoustic resonances at alternating lamp currents below a lowest lamp resonant frequency, and said ballast circuit energizes said discharge lamp so as to have an alternating lamp current having a fundamental frequency and harmonics which are integral multiples of the fundamental frequency, said fundamental frequency and said lowest lamp resonant frequency being greater than about 19 kHz, and any said harmonics greater than said lowest lamp resonant frequency having magnitudes which are insufficient to induce acoustic resonance.

37. An integrated lamp according to claim 36, wherein said ballast maintains said fundamental frequency substantially constant during steady state lamp operation.

38. An integrated lamp according to claim 37, wherein said discharge vessel encloses a circular-cylindrical discharge space substantially planar end walls, said end walls being spaced by an axial distance L said discharge space having a substantially constant inner diameter ID over said distance L, and the ratio L:ID is about 1:1.

39. An integrated lamp according to claim 37, wherein said dimensions L and ID are each about 3 mm.

40. An integrated HID reflector lamp according to claim 31, wherein said ballast comprises switching means for providing a current through the discharge device having a constant polarity.

41. An integrated HID reflector lamp according to claim 40, wherein said discharge device comprises a ceramic wall.

42. A high frequency metal halide lamp system according to claim 31, further comprising a starting aid for said discharge device, said starting aid comprising a length of conductive material extending from one said current conductor to the area of the other said current conductor and terminating adjacent the discharge vessel wall of the other said current conductor, said discharge vessel wall of the other said current conductor enclosing a narrow gap with the other said current conductor in which said discharge sustaining fill is present.

* * * * *